US009673033B2

(12) United States Patent
Grinfeld et al.

(10) Patent No.: US 9,673,033 B2
(45) **Date of Patent: *Jun. 6, 2017**

(54) MULTI-REFLECTION MASS SPECTROMETER

(71) Applicant: Thermo Fisher Scientific (Bremen) GmbH, Bremen (DE)

(72) Inventors: Dmitry Grinfeld, Bremen (DE); Alexander Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/853,892

(22) Filed: Sep. 14, 2015

(65) Prior Publication Data

US 2016/0005580 A1 Jan. 7, 2016

Related U.S. Application Data

(63) Continuation of application No. 14/374,221, filed as application No. PCT/EP2013/051103 on Jan. 22, 2013, now Pat. No. 9,136,102.

(30) Foreign Application Priority Data

Jan. 27, 2012 (GB) ..... 1201405.6

(51) Int. Cl.
*H01J 49/40* (2006.01)
*H01J 49/06* (2006.01)
(Continued)

(52) U.S. Cl.
CPC ..... *H01J 49/06* (2013.01); *H01J 49/004* (2013.01); *H01J 49/005* (2013.01);
(Continued)

(58) Field of Classification Search
CPC ..... H01J 49/06; H01J 49/0031; H01J 49/004; H01J 49/4245
(Continued)

(56) References Cited

U.S. PATENT DOCUMENTS 6,998,607 B1 2/2006 Davis et al.
9,136,101 B2 * 9/2015 Grinfeld ..... H01J 49/406
(Continued)

FOREIGN PATENT DOCUMENTS

CN 101421818 A 4/2009
GB 2403063 A 12/2004
(Continued)

*Primary Examiner* — Nicole Ippolito
(74) *Attorney, Agent, or Firm* — Nicholas Cairns

(57) ABSTRACT

A multi-reflection mass spectrometer comprising two ion-optical mirrors, each mirror elongated generally along a drift direction (Y), each mirror opposing the other in an X direction and having a space therebetween, the X direction being orthogonal to Y; the mass spectrometer further comprising one or more compensation electrodes each electrode being located in or adjacent the space extending between the opposing mirrors; the compensation electrodes being configured and electrically biased in use so as to produce, in at least a portion of the space extending between the mirrors, an electrical potential offset which: (i) varies as a function of the distance along the drift length, and/or; (ii) has a different extent in the X direction as a function of the distance along the drift length. In a preferred embodiment the period of ion oscillation between the mirrors is not substantially constant along the whole of the drift length.

36 Claims, 17 Drawing Sheets

(51) Int. Cl.
*H01J 49/00* (2006.01)
*H01J 49/42* (2006.01)

(52) U.S. Cl.
CPC ..... *H01J 49/0031* (2013.01); *H01J 49/406* (2013.01); *H01J 49/4245* (2013.01)

(58) Field of Classification Search
USPC ..... 250/281, 282, 283, 286, 287
See application file for complete search history.

(56) References Cited

U.S. PATENT DOCUMENTS

| | | | |
|---|---|---|---|
| 2006/0214100 | A1 | 9/2006 | Verentchikov et al. |
| 2008/0087841 | A1 | 4/2008 | Verbeck et al. |
| 2010/0044558 | A1 | 2/2010 | Sudakov |
| 2011/0168880 | A1 | 7/2011 | Ristroph et al. |
| 2015/0028197 | A1 | 1/2015 | Grinfeld et al. |
| 2016/0005585 | A1* | 1/2016 | Grinfeld ..... H01J 49/406 250/283 |

FOREIGN PATENT DOCUMENTS

| | | | |
|---|---|---|---|
| GB | 2470599 | A | 12/2010 |
| GB | 2476964 | A | 7/2011 |
| GB | 2477007 | A | 7/2011 |
| GB | 2482785 | A | 2/2012 |
| GB | 2485825 | B2 | 5/2015 |
| JP | 2008-511964 | A | 4/2008 |
| SU | 1725289 | A1 | 4/1992 |
| WO | WO 2006/102430 | A2 | 9/2006 |
| WO | WO 2007/044696 | A1 | 4/2007 |
| WO | 2007/122378 | A2 | 11/2007 |
| WO | WO 2008/047891 | A2 | 4/2008 |
| WO | WO 2010/008386 | A1 | 1/2010 |

* cited by examiner

MULTI-REFLECTION MASS SPECTROMETER

CROSS-REFERENCE TO RELATED APPLICATIONS

The present application is a continuation under 35 U.S.C. §120 and claims the priority benefit of co-pending U.S. patent application Ser. No. 14/374,221, filed Jul. 23, 2014, which is a National Stage application under 35 U.S.C. §371 of PCT Application No. PCT/EP2013/051103, filed Jan. 22, 2013. The disclosures of each of the foregoing applications are incorporated herein by reference.

FIELD OF THE INVENTION

This invention relates to the field of mass spectrometry, in particular high mass resolution time-of-flight mass spectrometry and electrostatic trap mass spectrometry utilizing multi-reflection techniques for extending the ion flight path.

BACKGROUND OF THE INVENTION

Various arrangements utilizing multi-reflection to extend the flight path of ions within mass spectrometers are known. Flight path extension is desirable to increase time-of-flight separation of ions within time-of-flight (TOF) mass spectrometers or to increase the trapping time of ions within electrostatic trap (EST) mass spectrometers. In both cases the ability to distinguish small mass differences between ions is thereby improved.

An arrangement of two parallel opposing mirrors was described by Nazarenko et. al. in patent SU1725289. These mirrors were elongated in a drift direction and ions followed a zigzag flight path, reflecting between the mirrors and at the same time drifting relatively slowly along the extended length of the mirrors in the drift direction. Each mirror was made of parallel bar electrodes. The number of reflection cycles and the mass resolution achieved were able to be adjusted by altering the ion injection angle. The design was advantageously simple in that only two mirror structures needed to be produced and aligned to one another. However this system lacked any means to prevent beam divergence in the drift direction. Due to the initial angular spread of the injected ions, after multiple reflections the beam width may exceed the width of the detector making any further increase of the ion flight time impractical due to the loss of sensitivity. Ion beam divergence is especially disadvantageous if trajectories of ions that have undergone a different number of reflections overlap, thus making it impossible to detect only ions having undergone a given number of oscillations. As a result, the design has a limited angular acceptance and/or limited maximum number of reflections. Furthermore, the ion mirrors did not provide time-of-flight focusing with respect to the initial ion beam spread across the plane of the folded path, resulting in degraded time-of-flight resolution for a wide initial beam angular divergence.

Wollnik, in GB patent 2080021, described various arrangements of parallel opposing gridless ion mirrors. Two rows of mirrors in a linear arrangement and two opposing rings of mirrors were described. Some of the mirrors may be tilted to effect beam injection. Each mirror was rotationally symmetric and was designed to produce spatial focusing characteristics so as to control the beam divergence at each reflection, thereby enabling a longer flight path to be obtained with low beam losses. However these arrangements were complex to manufacture, being composed of multiple high-tolerance mirrors that required precise alignment with one another. The number of reflections as the ions passed once through the analyser was fixed by the number of mirrors and could not be altered.

Su described a gridded parallel plate mirror arrangement elongated in a drift direction, in International Journal of Mass Spectrometry and Ion Processes, 88 (1989) 21-28. The opposing ion reflectors were arranged to be parallel to each other and ions followed a zigzag flight path for a number of reflections before reaching a detector. The system had no means for controlling beam divergence in the drift direction, and this, together with the use of gridded mirrors which reduced the ion flux at each reflection, limited the useful number of reflections and hence flight path length.

Verentchikov, in WO2005/001878 and GB2403063 described the use of periodically spaced lenses located within the field free region between two parallel elongated opposing mirrors. The purpose of the lenses was to control the beam divergence in the drift direction after each reflection, thereby enabling a longer flight path to be advantageously obtained over the elongated mirror structures described by Nazarenko at al. and Su. To further increase the path length, it was proposed that a deflector be placed at the distal end of the mirror structure from the ion injector, so that the ions may be deflected back through the mirror structure, doubling the flight path length. However the use of a deflector in this way is prone to introducing beam aberrations which would ultimately limit the maximum resolving power that could be obtained. In this arrangement the number of reflections is set by the position of the lenses and there is not the possibility to change the number of reflections and thereby the flight path length by altering the ion injection angle. The construction is also complex, requiring precise alignment of the multiple lenses. Lenses and the end deflector are furthermore known to introduce beam aberrations and ultimately this placed limits on the types of injection devices that could be used and reduced the overall acceptance of the analyser. In addition, the beam remains tightly focused over the entire path making it more susceptible to space charge effects.

Makarov et. al., in WO2009/081143, described a further method of introducing beam focusing in the drift direction for a multi-reflection elongated TOF mirror analyser. Here, a first gridless elongated mirror was opposed by a set of individual gridless mirrors elongated in a perpendicular direction, set side by side along the drift direction parallel to the first elongated mirror. The individual mirrors provided beam focusing in the drift direction. Again in this arrangement the number of beam oscillations within the device is set by the number of individual mirrors and cannot be adjusted by altering the beam injection angle. Whilst less complex than the arrangement of Wollnik and that of Verentchikov, nevertheless this construction is more complex than the arrangement of Nazarenko et. al. and that of Su.

Golikov, in WO2009001909, described two asymmetrical opposed mirrors, arranged parallel to one another. In this arrangement the mirrors, whilst not rotationally symmetric, did not extend in a drift direction and the mass analyzer typically has a narrow mass range because the ion trajectories spatially overlap on different oscillations and cannot be separated. The use of image current detection was proposed.

A further proposal for providing beam focusing in the drift direction in a system comprising elongated parallel opposing mirrors was provided by Verentchikov and Yavor in WO2010/008386. In this arrangement periodic lenses were introduced into one or both the opposing mirrors by periodically modulating the electric field within one or both the mirrors at set spacings along the elongated mirror structures. Again in this construction the number of beam oscillations cannot be altered by changing the beam injection angle, as the beam must be precisely aligned with the modulations in one or both the mirrors. Each mirror is somewhat more complex in construction than the simple planar mirrors proposed by Nazarenko et. al.

A somewhat related approach was proposed by Ristroph et. al. in US2011/0168880. Opposing elongated ion mirrors comprise mirror unit cells, each having curved sections to provide focusing in the drift direction and to compensate partially or fully for a second order time-of-flight aberration with respect to the drift direction. In common with other arrangements, the number of beam oscillations cannot be altered by changing the beam injection angle, as the beam must be precisely aligned with the unit cells. Again the mirror construction is more complex than that of Nazarenko et. al.

All arrangements which maintain the ions in a narrow beam in the drift direction with the use of periodic structures necessarily suffer from the effects of space-charge repulsion between ions.

Sudakov, in WO2008/047891, proposed an alternative means for both doubling the flight path length by returning ions back along the drift length and at the same time inducing beam convergence in the drift direction. In this arrangement the two parallel gridless mirrors further comprise a third mirror oriented perpendicularly to the opposing mirrors and located at the distal end of the opposing mirrors from the ion injector. The ions are allowed to diverge in the drift direction as they proceed through the analyser from the ion injector, but the third ion mirror reverts this divergence and, after reflection in the third mirror, upon arriving back in the vicinity of the ion injector the ions are once again converged in the drift direction. This advantageously allows the ion beam to be spread out in space throughout most of its journey through the analyser, reducing space charge interactions, as well as avoiding the use of multiple periodic structures along or between the mirrors for ion focusing. The third mirror also induces spatial focussing with respect to initial ion energy in the drift direction. There being no individual lenses or mirror cells, the number of reflections can be set by the injection angle. However, the third mirror is necessarily built into the structure of the two opposing elongated mirrors and effectively sections the elongated mirrors, i.e. the elongated mirrors are no longer continuous—and nor is the third mirror. This has the disadvantageous effect of inducing a discontinuous returning force upon the ions due to the step-wise change in the electric field in the gaps between the sections. This is particularly significant since the sections occur near the turning point in the drift direction where the ion beam width is at its maximum. This can lead to uncontrolled ion scattering and differing flight times for ions reflected within more than one section during a single oscillation.

In view of the above, the present invention has been made.

SUMMARY OF THE INVENTION

According to an aspect of the present invention there is provided a multi-reflection mass spectrometer comprising two ion-optical mirrors, each mirror elongated generally along a drift direction (Y), each mirror opposing the other in an X direction, the X direction being orthogonal to Y, characterized in that the mirrors are not a constant distance from each other in the X direction along at least a portion of their lengths in the drift direction.

According to a further aspect of the present invention there is provided a multi-reflection mass spectrometer comprising two ion-optical mirrors, each mirror elongated generally along a drift direction (Y), each mirror opposing the other in an X direction, the X direction being orthogonal to Y, characterized in that the mirrors are inclined to one other in the X direction along at least a portion of their lengths in the drift direction.

According to a further aspect of the present invention there is provided a multi-reflection mass spectrometer comprising two ion-optical mirrors, each mirror elongated generally along a drift direction (Y), each mirror opposing the other in an X direction, the X direction being orthogonal to Y, characterized in that the mirrors converge towards each other in the X direction along at least a portion of their lengths in the drift direction.

The present invention further provides a method of mass spectrometry comprising the steps of injecting ions into a multi-reflection mass spectrometer comprising two ion-optical mirrors, each mirror elongated generally along a drift direction (Y), each mirror opposing the other in an X direction, the X direction being orthogonal to Y, characterized in that the mirrors are not a constant distance from each other in the X direction along at least a portion of their lengths in the drift direction; and detecting at least some of the ions during or after their passage through the mass spectrometer.

The present invention further provides a method of mass spectrometry comprising the steps of injecting ions into a multi-reflection mass spectrometer comprising two ion-optical mirrors, each mirror elongated generally along a drift direction (Y), each mirror opposing the other in an X direction, the X direction being orthogonal to Y, characterized in that the mirrors are inclined to one other in the X direction along at least a portion of their lengths in the drift direction; and detecting at least some of the ions during or after their passage through the mass spectrometer.

The present invention further provides a method of mass spectrometry comprising the steps of injecting ions into a multi-reflection mass spectrometer comprising two ion-optical mirrors, each mirror elongated generally along a drift direction (Y), each mirror opposing the other in an X direction, the X direction being orthogonal to Y, characterized in that the mirrors converge towards each other in the X direction along at least a portion of their lengths in the drift direction; and detecting at least some of the ions during or after their passage through the mass spectrometer.

Preferably, methods of mass spectrometry using the present invention further comprise injecting ions into the multi-reflection mass spectrometer from one end of the opposing ion-optical mirrors in the drift direction and the ion-optical mirrors are closer together in the X direction along at least a portion of their lengths as they extend in the drift direction away from the location of ion injection.

For convenience herein, the drift direction shall be termed the Y direction, the opposing mirrors are set apart from one another by a distance in what shall be termed the X direction, the X direction being orthogonal to the Y direction, this distance varying at different locations in the Y direction as described above. The ion flight path generally occupies a volume of space which extends in the X and Y directions, the ions reflecting between the opposing mirrors and at the same time progressing along the drift direction Y. The mirrors generally being of smaller dimensions in the perpendicular Z direction, the volume of space occupied by the ion flight path is a slightly distorted rectangular parallelepiped with a smallest dimension preferably being in the Z direction. For convenience of the description herein, ions are injected into the mass spectrometer with initial components of velocity in the +X and +Y directions, progressing initially towards a first ion-optical mirror located in a +X direction and along the drift length in a +Y direction. The average component of velocity in the Z direction is preferably zero.

The ion optical mirrors oppose one another. By opposing mirrors it is meant that the mirrors are oriented so that ions directed into a first mirror are reflected out of the first mirror towards a second mirror and ions entering the second mirror are reflected out of the second mirror towards the first mirror. The opposing mirrors therefore have components of electric field which are generally oriented in opposite directions and facing one another.

The multi-reflection mass spectrometer comprises two ion-optical mirrors, each mirror elongated predominantly in one direction. The elongation may be linear (i.e. straight), or the elongation may be non-linear (e.g. curved or comprising a series of small steps so as to approximate a curve), as will be further described. The elongation shape of each mirror may be the same or it may be different. Preferably the elongation shape for each mirror is the same. Preferably the mirrors are a pair of symmetrical mirrors. Where the elongation is linear, in some embodiments of the present invention, the mirrors are not parallel to each other. Where the elongation is non-linear, in some embodiments of the present invention at least one mirror curves towards the other mirror along at least a portion of its length in the drift direction.

The mirrors may be of any known type of elongated ion mirror. In embodiments where the one or both elongated mirrors is curved, the basic design of known elongated ion mirrors may be adapted to produce the required curved mirror. The mirrors may be gridded or the mirrors may be gridless. Preferably the mirrors are gridless.

As herein described, the two mirrors are aligned to one another so that they lie in the X-Y plane and so that the elongated dimensions of both mirrors lie generally in the drift direction Y. The mirrors are spaced apart and oppose one another in the X direction. However, in some embodiments, as the distance or gap between the mirrors is arranged to vary as a function of the drift distance, i.e. as a function of Y, the elongated dimensions of both mirrors will not lie precisely in the Y direction and for this reason the mirrors are described as being elongated generally along the drift direction Y. In these embodiments the elongated dimension of at least one mirror will be at an angle to the Y direction for at least a portion of its length. Preferably the elongated dimension of both mirrors will be at an angle to the Y direction for at least a portion of its length.

Herein, in both the description and the claims, the distance between the opposing ion-optical mirrors in the X direction means the distance between the average turning points of ions within those mirrors at a given position along the drift length Y. A precise definition of the effective distance L between the mirrors that have a field-free region between them (where that is the case), is the product of the average ion velocity in the field-free region and the time lapse between two consecutive turning points. An average turning point of ions within a mirror herein means the maximum distance in the +/−X direction within the mirror that ions having average kinetic energy and average initial angular divergence characteristics reach, i.e. the point at which such ions are turned around in the X direction before proceeding back out of the mirror. Ions having a given kinetic energy in the +/−X direction are turned around at an equipotential surface within the mirror. The locus of such points at all positions along the drift direction of a particular mirror defines the turning points for that mirror, and the locus is hereinafter termed an average reflection surface. Therefore the variation in distance between the opposing ion-optical mirrors is defined by the variation in distance between the opposing average reflection surfaces of the mirrors. In both the description and claims reference to the distance between the opposing ion-optical mirrors is intended to mean the distance between the opposing average reflection surfaces of the mirrors as just defined. In the present invention, immediately before the ions enter each of the opposing mirrors at any point along the elongated length of the mirrors they possess their original kinetic energy in the +/−X direction. The distance between the opposing ion-optical mirrors may therefore also be defined as the distance between opposing equipotential surfaces where the nominal ions (those having average kinetic energy and average initial angular incidence) turn in the X direction, the said equipotential surfaces extending along the elongated length of the mirrors.

In the present invention, the mechanical construction of the mirrors themselves may appear, under superficial inspection, to maintain a constant distance apart in X as a function of Y, whilst the average reflection surfaces may actually be at differing distances apart in X as a function of Y. For example, one or more of the opposing ion-optical mirrors may be formed from conductive tracks disposed upon an insulating former (such as a printed circuit board) and the former of one such mirror may be arranged a constant distance apart from an opposing mirror along the whole of the drift length whilst the conductive tracks disposed upon the former may not be a constant distance from electrodes in the opposing mirror. Even if electrodes of both mirrors are arranged a constant distance apart along the whole drift length, different electrodes may be biased with different electrical potentials within one or both mirrors along the drift lengths, causing the distance between the opposing average reflection surfaces of the mirrors to vary along the drift length. Thus, the distance between the opposing ion-optical mirrors in the X direction varies along at least a portion of the length of the mirrors in the drift direction.

Preferably the variation in distance between the opposing ion-optical mirrors in the X direction varies smoothly as a function of the drift distance. In some embodiments of the present invention the variation in distance between the opposing ion-optical mirrors in the X direction varies linearly as a function of the drift distance. In some embodiments of the present invention the variation in distance between the opposing ion-optical mirrors in the X direction varies non-linearly as a function of the drift distance.

In some embodiments of the present invention the opposing mirrors are elongated linearly generally in the drift direction and are not parallel to each other (i.e. they are inclined to one another along their whole length) and in such embodiments the variation in distance between the opposing ion-optical mirrors in the X direction varies linearly as a function of the drift distance. In a preferred embodiment the two mirrors are further apart from each other at one end, that end being in a region adjacent an ion injector, i.e. the elongated ion-optical mirrors are closer together in the X direction along at least a portion of their lengths as they extend in the drift direction away from the ion injector. In some embodiments of the present invention at least one mirror and preferably each mirror curves towards or away from the other mirror along at least a portion of its length in the drift direction and in such embodiments the variation in distance between the opposing ion-optical mirrors in the X direction varies non-linearly as a function of the drift distance. In a preferred embodiment both mirrors are shaped so as to produce a curved reflection surface, that reflection surface following a parabolic shape so as to curve towards each other as they extend in the drift direction away from the location of an ion injector. In such embodiments the two mirrors are therefore further apart from each other at one end, in a region adjacent an ion injector. Some embodiments of the present invention provide the advantages that both an extended flight path length and spatial focusing of ions in the drift (Y) direction is accomplished by use of non-parallel mirrors. Such embodiments advantageously need no additional components to both double the drift length by causing ions to turn around and proceed back along the drift direction (i.e. travelling in the −Y direction) towards an ion injector and to induce spatial focusing of the ions along the Y direction when they return to the vicinity of the ion injector—only two opposing mirrors need be utilised. A further advantage accrues from an embodiment in which the opposing mirrors are curved towards each other with parabolic profiles as they elongate away from one end of the spectrometer adjacent an ion injector as this particular geometry further advantageously causes the ions to take the same time to return to their point of injection independent of their initial drift velocity.

The two elongated ion-optical mirrors may be similar to each other or they may differ. For example, one mirror may comprise a grid whilst the other may not; one mirror may comprise a curved portion whilst the other mirror may be straight. Preferably both mirrors are gridless and similar to each other. Most preferably the mirrors are gridless and symmetrical.

Preferably, an ion injector injects ions from one end of the mirrors into the space between the mirrors at an inclination angle to the X axis in the X-Y plane such that ions are reflected from one opposing mirror to the other a plurality of times whilst drifting along the drift direction away from the ion injector so as to follow a generally zigzag path within the mass spectrometer. The motion of ions along the drift direction is opposed by an electric field component resulting from the non-constant distance of the mirrors from each other along at least a portion of their lengths in the drift direction and the said electric field component causes the ions to reverse their direction and travel back towards the ion injector. The ions may undergo an integer or a non-integer number of complete oscillations between the mirrors before returning to the vicinity of the ion injector. Preferably, the inclination angle of the ion beam to the X axis decreases with each reflection in the mirrors as the ions move along the drift direction away from the injector. Preferably, this continues until the inclination angle is reversed in direction and the ions return back along the drift direction towards the injector.

Preferably embodiments of the present invention further comprise a detector located in a region adjacent the ion injector. Preferably the ion injector is arranged to have a detection surface which is parallel to the drift direction Y, i.e. the detection surface is parallel to the Y axis.

The multi-reflection mass spectrometer may form all or part of a multi-reflection time-of-flight mass spectrometer. In such embodiments of the invention, preferably the ion detector located in a region adjacent the ion injector is arranged to have a detection surface which is parallel to the drift direction Y, i.e. the detection surface is parallel to the Y axis. Preferably the ion detector is arranged so that ions that have traversed the mass spectrometer, moving forth and back along the drift direction as described above, impinge upon the ion detection surface and are detected. The ions may undergo an integer or a non-integer number of complete oscillations between the mirrors before impinging upon a detector. The ions preferably undergo only one oscillation in the drift direction in order that the ions do not follow the same path more than once so that there is no overlap of ions of different m/z, thus allowing full mass range analysis. However if a reduced mass range of ions is desired or is acceptable, more than one oscillation in the drift direction may be made between the time of injection and the time of detection of ions, further increasing the flight path length.

Additional detectors may be located within the multi-reflection mass spectrometer, with or without additional ion beam deflectors. Additional ion beam deflectors may be used to deflect ions onto one or more additional detectors, or alternatively additional detectors may comprise partially transmitting surfaces such as diaphragms or grids so as to detect a portion of an ion beam whilst allowing a remaining portion to pass on. Additional detectors may be used for beam monitoring in order to detect the spatial location of ions within the spectrometer, or to measure the quantity of ions passing through the spectrometer, for example. Hence more than one detector may be used to detect at least some of the ions during or after their passage through the mass spectrometer.

The multi-reflection mass spectrometer may form all or part of a multi-reflection electrostatic trap mass spectrometer, as will be further described. In such embodiments of the invention, the detector located in a region adjacent the ion injector preferably comprises one or more electrodes arranged to be close to the ion beam as it passes by, but located so as not to intercept it, the detection electrodes connected to a sensitive amplifier enabling the image current induced in the detection electrodes to be measured.

Advantageously, embodiments of the present invention may be constructed without the inclusion of any additional lenses or diaphragms in the region between the opposing ion optical mirrors. However additional lenses or diaphragms might be used with the present invention in order to affect the phase-space volume of ions within the mass spectrometer and embodiments are conceived comprising one or more lenses and diaphragms located in the space between the mirrors.

Preferably the multi-reflection mass spectrometer further comprises compensation electrodes, extending along at least a portion of the drift direction in or adjacent the space between the mirrors. Compensation electrodes allow further advantages to be provided, in particular in some embodiments that of reducing time-of-flight aberrations.

In some embodiments of the present invention, compensation electrodes are used with opposing ion optical mirrors elongated generally along the drift direction, each mirror opposing the other in an X direction, the X direction being orthogonal to Y, characterized in that the mirrors are not a constant distance from each other in the X direction along at least a portion of their lengths in the drift direction. In other embodiments of the invention, compensation electrodes are used with opposing ion optical mirrors elongated generally along the drift direction, each mirror opposing the other in an X direction, the X direction being orthogonal to Y, the mirrors being maintained a constant distance from each other in the X direction along their lengths in the drift direction. In both cases preferably the compensation electrodes create components of electric field which oppose ion motion along the +Y direction along at least a portion of the ion optical mirror lengths in the drift direction. These components of electric field preferably provide or contribute to a returning force upon the ions as they move along the drift direction.

The one or more compensation electrodes may be of any shape and size relative to the mirrors of the multi-reflection mass spectrometer. In preferred embodiments the one or more compensation electrodes comprise extended surfaces parallel to the X-Y plane facing the ion beam, the electrodes being displaced in +/−Z from the ion beam flight path, i.e. each one or more electrodes preferably having a surface substantially parallel to the X-Y plane, and where there are two such electrodes, preferably being located either side of a space extending between the opposing mirrors. In another preferred embodiment, the one or more compensation electrodes are elongated in the Y direction along a substantial portion of the drift length, each electrode being located either side of the space extending between the opposing mirrors. In this embodiment preferably the one or more compensation electrodes are elongated in the Y direction along a substantial portion, the substantial portion being at least one or more of: 1/10; 1/5; 1/4; 1/3; 1/2; 3/4 of the drift length. Preferably the one or more compensation electrodes comprise two compensation electrodes elongated in the Y direction along a substantial portion of the drift length, the substantial portion being at least one or more of: 1/10; 1/5; 1/4; 1/3; 1/2; 3/4 of the drift length, one electrode displaced in the +Z direction from the ion beam flight path, the other electrode displaced in the −Z direction from the ion beam flight path, the two electrodes thereby being located either side of a space extending between the opposing mirrors. However other geometries are anticipated. Preferably, the compensation electrodes are electrically biased in use such that the total time of flight of ions is substantially independent of the incidence angle of the ions. As the total drift length travelled by the ions is dependent upon the incidence angle of the ions, the total time of flight of ions is substantially independent of the drift length travelled.

Compensation electrodes may be biased with an electrical potential. Where a pair of compensation electrodes is used, each electrode of the pair may have the same electrical potential applied to it, or the two electrodes may have differing electrical potentials applied. Preferably where there are two electrodes, the electrodes are located symmetrically either side of a space extending between the opposing mirrors and the electrodes are both electrically biased with substantially equal potentials.

In some embodiments, one or more pairs of compensation electrodes may have each electrode in the pair biased with the same electrical potential and that electrical potential may be zero volts with respect to what is herein termed as an analyser reference potential. Typically the analyser reference potential will be ground potential, but it will be appreciated that the analyser may be arbitrarily raised in potential, i.e. the whole analyser may be floated up or down in potential with respect to ground. As used herein, zero potential or zero volts is used to denote a zero potential difference with respect to the analyser reference potential and the term non-zero potential is used to denote a non-zero potential difference with respect to the analyser reference potential. Typically the analyser reference potential is, for example, applied to shielding such as electrodes used to terminate mirrors, and as herein defined is the potential in the drift space between the opposing ion optical mirrors in the absence of all other electrodes besides those comprising the mirrors.

In preferred embodiments, two or more pairs of opposing compensation electrodes are provided. In such embodiments, some pairs of compensation electrodes in which each electrode is electrically biased with zero volts are further referred to as unbiased compensation electrodes, and other pairs of compensation electrodes having non-zero electric potentials applied are further referred to as biased compensation electrodes. Preferably, where each of the biased compensation electrodes has a surface having a polynomial profile in the X-Y plane, the unbiased compensation electrodes have surfaces complimentarily shaped with respect to the biased compensation electrodes, examples of which will be further described. Typically the unbiased compensation electrodes terminate the fields from biased compensation electrodes. In a preferred embodiment, surfaces of at least one pair of compensation electrodes have a parabolic profile in the X-Y plane, such that the said surfaces extend towards each mirror a greater distance in the regions near one or both the ends of the mirrors than in the central region between the ends. In another preferred embodiment, at least one pair of compensation electrodes have surfaces having a polynomial profile in the X-Y plane, more preferably a parabolic profile in the X-Y plane, such that the said surfaces extend towards each mirror a lesser distance in the regions near one or both the ends of the mirrors than in the central region between the ends. In such embodiments preferably the pair(s) of compensation electrodes extend along the drift direction Y from a region adjacent an ion injector at one end of the elongated mirrors, and the compensation electrodes are substantially the same length in the drift direction as the extended mirrors, and are located either side of a space between the mirrors. In alternative embodiments, the compensation electrode surfaces as just described may be made up of multiple discrete electrodes.

In other embodiments, compensation electrodes may be located partially or completely within the space extending between the opposing mirrors, the compensation electrodes comprising a set of separate tubes or compartments. Preferably the tubes or compartments are centred upon the X-Y plane and are located along the drift length so that ions pass through the tubes or compartments and do not impinge upon them. The tubes or compartments preferably have different lengths at different locations along the drift length, and/or have different electrical potentials applied as a function of their location along the drift length.

Preferably, in all embodiments of the present invention, the compensation electrodes do not comprise ion optical mirrors in which the ion beam encounters a potential barrier at least as large as the kinetic energy of the ions in the drift direction. However, as has already been stated and will be further described, they preferably create components of electric field which oppose ion motion along the +Y direction along at least a portion of the ion optical mirror lengths in the drift direction.

Preferably the one or more compensation electrodes are, in use, electrically biased so as to compensate for at least some of the time-of-flight aberrations generated by the opposing mirrors. Where there is more than one compensation electrode, the compensation electrodes may be biased with the same electrical potential, or they may be biased with different electrical potentials. Where there is more than one compensation electrode one or more of the compensation electrodes may be biased with a non-zero electrical potential whilst other compensation electrodes may be held at another electrical potential, which may be zero potential. In use, some compensation electrodes may serve the purpose of limiting the spatial extent of the electric field of other compensation electrodes. Preferably where there is a first pair of opposing compensation electrodes spaced either side of the beam flight path between the mirrors of the multi-reflection mass spectrometer, the first pair of compensation electrodes will be electrically biased with the same non-zero potential, and, the multi-reflection mass spectrometer further preferably comprises two additional pairs of compensation electrodes, which are located either side of the first pair of compensation electrodes in +/−X directions, the further pairs of compensation electrodes being held at zero potential, i.e. being unbiased compensation electrodes. In another preferred embodiment, three pairs of compensation electrodes are utilised, with a first pair of unbiased compensation electrodes held at zero potential and either side of these compensation electrodes in +/−X directions two further pairs of biased compensation electrodes held at a non-zero electrical potential. In some embodiments, one or more compensation electrodes may comprise a plate coated with an electrically resistive material which has different electrical potentials applied to it at different ends of the plate in the Y direction, thereby creating an electrode having a surface with a varying electrical potential across it as a function of the drift direction Y. Accordingly, electrically biased compensation electrodes may be held at no one single potential. Preferably the one or more compensation electrodes are, in use, electrically biased so as to compensate for a time-of-flight shift in the drift direction generated by the opposing mirrors and so as to make a total time-of-flight shift of the system substantially independent of an initial ion beam trajectory inclination angle in the X-Y plane, as will be further described. The electrical potentials applied to compensation electrodes may be held constant or may be varied in time. Preferably the potentials applied to the compensation electrodes are held constant in time whilst ions propagate through the multi-reflection mass spectrometer. The electrical bias applied to the compensation electrodes may be such as to cause ions passing in the vicinity of a compensation electrode so biased to decelerate, or to accelerate, the shapes of the compensation electrodes differing accordingly, examples of which will be further described.

As herein described, the term "width" as applied to compensation electrodes refers to the physical dimension of the biased compensation electrode in the +/−X direction.

Preferably, the compensation electrodes are so configured and biased in use to create one or more regions in which an electric field component in the Y direction is created which opposes the motion of the ions along the +Y drift direction. The compensation electrodes thereby cause the ions to lose velocity in the drift direction as they proceed along the drift length in the +Y direction and the configuration of the compensation electrodes and biasing of the compensation electrodes is arranged to cause the ions to turn around in the drift direction before reaching the end of the mirrors and return back towards the ion injection region. Advantageously this is achieved without sectioning the opposing mirrors and without introducing a third mirror. Preferably the ions are brought to a spatial focus in the region of the ion injector where a suitable detection surface is arranged, as described for other embodiments of the invention. Preferably the electric field in the Y direction creates a force which opposes the motion of ions linearly as a function of distance in the drift direction (a quadratic opposing electrical potential) as will be further described.

Preferably, methods of mass spectrometry using the present invention further comprise injecting ions into a multi-reflection mass spectrometer comprising compensation electrodes, extending along at least a portion of the drift direction in or adjacent the space between the mirrors. Preferably the ions are injected from an ion injector located at one end of the opposing mirrors in the drift direction and in some embodiments ions are detected by impinging upon a detector located in a region in the vicinity of the ion injector, e.g. adjacent thereto. In other embodiments ions are detected by image current detection means, as described above. The mass spectrometer to be used in the method of the present invention may further comprise components with details as described above.

The present invention further provides an ion optical arrangement comprising two ion-optical mirrors, each mirror elongated generally along a drift direction (Y), each mirror opposing the other in an X direction and having a space therebetween, the X direction being orthogonal to Y, characterized in that the mirrors are not a constant distance from each other in the X direction along at least a portion of their lengths in the drift direction. In use, ions are reflected between the ion optical mirrors whilst proceeding a distance along the drift direction between reflections, the ions reflecting a plurality of times, and the said distance varies as a function of the ions' position along at least part of the drift direction. The ion-optical arrangement may further comprise one or more compensation electrodes each electrode being located in or adjacent the space extending between the opposing mirrors, the compensation electrodes being arranged and electrically biased in use so as to produce, in the X-Y plane, an electrical potential offset which: (i) varies as a function of the distance along the drift length along at least a portion of the drift length, and/or; (ii) has a different extent in the X direction as a function of the distance along the drift length along at least a portion of the drift length.

In some preferred embodiments which will be further described, the ion beam velocity is changed in such a way that all time-of-flight aberrations caused by non-parallel opposing ion optical mirrors are corrected. In such embodiments it is found that the change of the oscillation period resulting from a varying distance between the mirrors along the drift length is completely compensated by the change of the oscillation period resulting from the electrically biased compensation electrodes, in which case ions undergo a substantially equal oscillation time on each oscillation between the opposing ion-optical mirrors at all locations along the drift length even though the distance between the mirrors changes along the drift length. In other preferred embodiments of the invention the electrically biased compensation electrodes correct substantially the oscillation period so that the time-of-flight aberrations caused by non-parallel opposing ion optical mirrors are substantially compensated and only after a certain number of oscillations when the ions reach the plane of detection. It will be appreciated that for these embodiments, in the absence of the electrically biased compensation electrodes, the ion oscillation period between the opposing ion-optical mirrors would not be substantially constant, but would reduce as the ions travel along portions of the drift length in which the opposing mirrors are closer together.

Accordingly, the present invention further provides a method of mass spectrometry comprising the steps of injecting ions into an injection region of a multi-reflection mass spectrometer comprising two ion-optical mirrors, each mirror elongated generally along a drift direction (Y), each mirror opposing the other in an X direction and having a space therebetween, the X direction being orthogonal to Y, so that the ions oscillate between the opposing mirrors whilst proceeding along a drift length in the Y direction; the spectrometer further comprising one or more compensation electrodes each electrode being located in or adjacent the space extending between the opposing mirrors, the compensation electrodes being, in use, electrically biased such that the period of ion oscillation between the mirrors is substantially constant along the whole of the drift length; and detecting at least some of the ions during or after their passage through the mass spectrometer.

The present invention further provides a multi-reflection mass spectrometer comprising two ion-optical mirrors, each mirror elongated generally along a drift direction (Y), each mirror opposing the other in an X direction and having a space therebetween, the X direction being orthogonal to Y, and further comprising one or more compensation electrodes each electrode being located in or adjacent the space extending between the opposing mirrors, the spectrometer further comprising an ion injector located at one end of the ion-optical mirrors in the drift direction arranged so that in use it injects ions such that they oscillate between the opposing mirrors whilst proceeding along a drift length in the Y direction; the compensation electrodes being, in use, electrically biased such that the period of ion oscillation between the mirrors is substantially constant along the whole of the drift length.

The present invention still further provides a multi-reflection mass spectrometer comprising two ion-optical mirrors, each mirror elongated generally along a drift direction (Y), each mirror opposing the other in an X direction and having a space therebetween, the X direction being orthogonal to Y, and an ion injector located at one end of the ion-optical mirrors in the drift direction arranged so that in use it injects ions such that they oscillate between the opposing mirrors whilst proceeding along a drift length in the Y direction; characterised in that the amplitude of ion oscillation between the mirrors is not substantially constant along the whole of the drift length. Preferably the amplitude decreases along at least a portion of the drift length as ions proceed away from the ion injector. Preferably the ions are turned around after passing along the drift length and proceed back along the drift length towards the ion injector.

The present invention further provides a method of mass spectrometry comprising the steps of injecting ions into a multi-reflection mass spectrometer comprising two ion-optical mirrors, each mirror elongated generally along a drift direction (Y), each mirror opposing the other in an X direction, the X direction being orthogonal to Y, reflecting the ions from one mirror to the other generally orthogonally to the drift direction a plurality of times by turning the ions within each mirror whilst the ions proceed along the drift direction Y, characterized in that the distance between consecutive points in the X direction at which the ions turn monotonously changes with Y during at least a part of the motion of the ions along the drift direction; and detecting at least some of the ions during or after their passage through the mass spectrometer.

As already described, preferably one or more compensation electrodes are so configured and biased in use to create one or more regions in which an electric field component in the Y direction is created which opposes the motion of the ions along the +Y drift direction. Compensation electrodes as described herein may be used to provide at least some of the advantages of the present invention when used with two opposing ion-optical mirrors elongated generally along a drift direction (Y), each mirror opposing the other in an X direction and having a space therebetween, the X direction being orthogonal to Y, the mirrors being a constant distance from each other, i.e. having an equal gap between them along the whole of their lengths in the drift direction, the average reflection surfaces of the opposing mirrors being a constant distance from each other along the whole of the drift length. In such embodiments, the opposing mirrors may be straight and arranged parallel to each other, for example, in which case the mirrors are a constant distance from each other in the X direction. In other embodiments the mirrors may be curved but be arranged to have an equal gap between them, i.e. they may be curved so as to form opposed sector shapes, with a constant gap between the sectors. In other embodiments the mirrors may form more complex shapes, but the mirrors have complementing shapes and the gap between them remains constant. The compensation electrodes preferably extend along at least a portion of the drift direction, each electrode being located in or adjacent the space extending between the opposing mirrors, the compensation electrodes being shaped and electrically biased in use so as to produce, in at least a portion of the space extending between the mirrors, an electrical potential offset which: (i) varies as a function of the distance along the drift length, and/or; (ii) has a different extent in the X direction as a function of the distance along the drift length. In these embodiments the compensation electrodes being so configured (i.e. shaped and arranged in space) and biased in use create one or more regions in which an electric field component in the Y direction is created which opposes the motion of the ions along the +Y drift direction. As the ions are repeatedly reflected from one ion optical mirror to the other and at the same time proceed along the drift length, the ions turn within each mirror. The distance between subsequent points at which the ions turn in the Y-direction changes monotonously with Y during at least a part of the motion of the ions along the drift direction, and the period of ion oscillation between the mirrors is not substantially constant along the whole of the drift length. The electrically biased compensation electrodes cause the ion velocity in the X direction (at least) to be altered along at least a portion of the drift length, and the period of the ion oscillation between the mirrors is thereby changed as a function of the at least a portion of the drift length. In such embodiments both mirrors are elongated along the drift direction and are arranged an equal distance apart in the X direction. In some embodiments both mirrors are elongated non-linearly along the drift direction and in other embodiments both mirrors are elongated linearly along the drift direction. Preferably for ease of manufacture both mirrors are elongated linearly along the drift direction, i.e. both mirrors are straight. In embodiments of the invention the period of ion oscillation decreases along at least a portion of the drift length as ions proceed away from the ion injector. Preferably the ions are turned around after passing along the drift length and proceed back along the drift length towards the ion injector. In embodiments of the present invention, compensation electrodes are used to alter the ion beam velocity and, therefore, the ion oscillation periods, as the ion beam passes near to a compensation electrode, or more preferably between a pair of compensation electrodes. The compensation electrodes thereby cause the ions to lose velocity in the drift direction and the configuration of the compensation electrodes and biasing of the compensation electrodes is arranged to preferably cause the ions to turn around in the drift direction before reaching the end of the mirrors and return back towards the ion injection region. Advantageously this is achieved without sectioning the opposing mirrors and without introducing a third mirror. Preferably the ions are brought to a spatial focus in the region of the ion injector where a suitable detection surface is arranged, as previously described for other embodiments of the invention. Preferably the electric field in the Y direction creates a force which opposes the motion of ions linearly as a function of distance in the drift direction (a quadratic opposing electrical potential) as will be further described.

Accordingly, embodiments of the present invention further provide a multi-reflection mass spectrometer comprising two ion-optical mirrors, each mirror elongated generally along a drift direction (Y), each mirror opposing the other in an X direction and having a space therebetween, the X direction being orthogonal to Y; the mass spectrometer further comprising one or more compensation electrodes each electrode being located in or adjacent the space extending between the opposing mirrors; the spectrometer further comprising an ion injector located at one end of the ion-optical mirrors in the drift direction, arranged so that in use it injects ions such that they oscillate between the ion-optical mirrors, reflecting from one mirror to the other generally orthogonally to the drift direction a plurality of times, turning the ions within each mirror whilst the ions proceed along the drift direction Y; characterized in that the compensation electrodes are, in use, electrically biased such that the distance between subsequent points at which the ions turn in the Y-direction changes monotonously with Y during at least a part of the motion of the ions along the drift direction. In addition, embodiments of the present invention also provide a multi-reflection mass spectrometer comprising two ion-optical mirrors, each mirror elongated generally along a drift direction (Y), each mirror opposing the other in an X direction and having a space therebetween, the X direction being orthogonal to Y, further comprising one or more compensation electrodes each electrode being located in or adjacent the space extending between the opposing mirrors, the compensation electrodes being electrically biased in use; the mass spectrometer further comprising an ion injector located at one end of the ion-optical mirrors in the drift direction, arranged so that in use it injects ions such that they oscillate between the opposing mirrors whilst proceeding along a drift length in the Y direction; characterised in that the period of ion oscillation between the mirrors is not substantially constant along the whole of the drift length. Embodiments of the present invention also provide a multi-reflection mass spectrometer comprising two ion-optical mirrors, each mirror elongated generally along a drift direction (Y), each mirror opposing the other in an X direction and having a space therebetween, the X direction being orthogonal to Y; the mass spectrometer further comprising one or more compensation electrodes each electrode being located in or adjacent the space extending between the opposing mirrors; the compensation electrodes being configured and electrically biased in use so as to produce, in at least a portion of the space extending between the mirrors, an electrical potential offset which: (i) varies as a function of the distance along the drift length, and/or; (ii) has a different extent in the X direction as a function of the distance along the drift length.

The invention further provides a method of mass spectrometry comprising the steps of injecting ions into a multi-reflection mass spectrometer comprising two ion-optical mirrors, each mirror elongated generally along a drift direction (Y), each mirror opposing the other in an X direction, the X direction being orthogonal to Y, the mass spectrometer further comprising one or more electrically biased compensation electrodes, each electrode being located in or adjacent the space extending between the opposing mirrors; reflecting the ions from one mirror to the other generally orthogonally to the drift direction a plurality of times by turning the ions within each mirror whilst the ions proceed along the drift direction Y, characterized in that the compensation electrodes produce in at least a portion of the space extending between the mirrors, an electrical potential offset which: (i) varies as a function of the distance along the drift length, and/or; (ii) has a different extent in the X direction as a function of the distance along the drift length; and detecting at least some of the ions during or after their passage through the mass spectrometer. The invention further provides a method of mass spectrometry comprising the steps of injecting ions into a multi-reflection mass spectrometer comprising two ion-optical mirrors, each mirror elongated generally along a drift direction (Y), each mirror opposing the other in an X direction, the X direction being orthogonal to Y, the mass spectrometer further comprising one or more electrically biased compensation electrodes, each electrode being located in or adjacent the space extending between the opposing mirrors; reflecting the ions from one mirror to the other generally orthogonally to the drift direction a plurality of times by turning the ions within each mirror whilst the ions proceed along the drift direction Y, characterized in that the distance between subsequent points in the Y-direction at which the ions turn monotonously changes with Y during at least a part of the motion of the ions along the drift direction and; detecting at least some of the ions during or after their passage through the mass spectrometer. The invention still further provides a method of mass spectrometry comprising the steps of: injecting ions into a multi-reflection mass spectrometer comprising two ion-optical mirrors, each mirror elongated generally along a drift direction (Y), each mirror opposing the other in an X direction and having a space therebetween, the X direction being orthogonal to Y, further comprising one or more compensation electrodes each electrode being located in or adjacent the space extending between the opposing mirrors; applying electrical biases to the mirrors and the compensation electrodes; the ions being injected from an ion injector located at one end of the ion-optical mirrors in the drift direction such that they oscillate between the opposing mirrors whilst proceeding along a drift length in the Y direction, characterised in that the period of ion oscillation between the mirrors is not substantially constant along the whole of the drift length and; detecting at least some of the ions during or after their passage through the mass spectrometer.

As described above, in some preferred embodiments the ion-optical mirrors are arranged so that the average reflection surfaces of the opposing mirrors are not a constant distance from each other in the X direction along at least a portion of the drift length. Alternatively in other embodiments the ion optical mirrors are arranged so that the average reflection surfaces of the opposing mirrors are maintained a constant distance from each other in the X direction along the whole drift length and the mass spectrometer further comprises electrically biased compensation electrodes as previously described. Most preferably the ion-optical mirrors are arranged so that the average reflection surfaces of the opposing mirrors are not a constant distance from each other in the X direction along at least a portion of the drift length and the mass spectrometer further comprises electrically biased compensation electrodes as previously described, in which case it is more preferable that the compensation electrodes are electrically biased such that the period of ion oscillation between the mirrors is substantially constant along the whole of the drift length.

In some preferred embodiments, the space between the opposing ion optical mirrors is open ended in the X-Z plane at each end of the drift length, whether the average reflection surfaces of the opposing mirrors are not a constant distance from each other in the X direction along at least a portion of the drift length or where the ion optical mirrors are arranged so that the average reflection surfaces of the opposing mirrors are maintained a constant distance from each other in the X direction along the whole drift length. By open ended in the X-Z plane it is meant that the mirrors are not bounded by electrodes in the X-Z plane which fully or substantially span the gap between the mirrors.

Embodiments of the multi-reflection mass spectrometer of the present invention may form all or part of a multi-reflection electrostatic trap mass spectrometer. A preferred electrostatic trap mass spectrometer comprises two multi-reflection mass spectrometers arranged end to end symmetrically about an X axis such that their respective drift directions are collinear, the multi-reflection mass spectrometers thereby defining a volume within which, in use, ions follow a closed path with isochronous properties in both the drift directions and in an ion flight direction.

The multi-reflection mass spectrometer of the present invention may form all or part of a multi-reflection time-of-flight mass spectrometer.

A composite mass spectrometer may be formed comprising two or more multi-reflection mass spectrometers aligned so that the X-Y planes of each mass spectrometer are parallel and optionally displaced from one another in a perpendicular direction Z, the composite mass spectrometer further comprising ion-optical means to direct ions from one multi-reflection mass spectrometer to another. In one such embodiment of a composite mass spectrometer a set of multi-reflection mass spectrometers are stacked one upon another in the Z direction and ions are passed from a first multi-reflection mass spectrometer in the stack to further multi-reflection mass spectrometers in the stack by means of deflection means, such as electrostatic electrode deflectors, thereby providing an extended flight path composite mass spectrometer in which ions do not follow the same path more than once, allowing full mass range TOF analysis as there is no overlap of ions. In another such embodiment of a composite mass spectrometer a set of multi-reflection mass spectrometers are each arranged to lie in the same X-Y plane and ions are passed from a first multi-reflection mass spectrometer to further multi-reflection mass spectrometers by means of deflection means, such as electrostatic electrode deflectors, thereby providing an extended flight path composite mass spectrometer in which ions do not follow the same path more than once, allowing full mass range TOF analysis as there is no overlap of ions. Other arrangements of multi-reflection mass spectrometers are envisaged in which some of the spectrometers lie in the same X-Y plane and others are displaced in the perpendicular Z direction, with ion-optical means arranged to pass ions from spectrometer to another thereby providing an extended flight path composite mass spectrometer in which ions do not follow the same path more than once. Preferably, where some spectrometers are stacked in Z direction, the said spectrometers have alternating orientations of the drift directions to avoid the requirement for deflection means in the drift direction.

Alternatively, embodiments of the present invention may be used with a further beam deflection means arranged to turn ions around and pass them back through the multi-reflection mass spectrometer or composite mass spectrometer one or more times, thereby multiplying the flight path length, though at the expense of mass range.

Analysis systems for MS/MS may be provided using the present invention comprising a multi-reflection mass spectrometer and, an ion injector comprising an ion trapping device upstream of the mass spectrometer, and a pulsed ion gate, a high energy collision cell and a time-of-flight analyser downstream of the mass spectrometer. Moreover, the same analyser could be used for both stages of analysis or multiple such stages of analysis thereby providing the capability of $MS^n$, by configuring the collision cell so that ions emerging from the collision cell are directed back into the ion trapping device.

The present invention provides a multi-reflection mass spectrometer and method of mass spectrometry comprising opposing mirrors elongated along a drift direction and means to provide a returning force opposing ion motion along the drift direction. In the present invention the returning force is smoothly distributed along a portion of the drift direction, most preferably along substantially the whole of the drift direction, reducing or eliminating uncontrolled ion scattering especially near the turning point in the drift direction where the ion beam width is at its maximum. This smooth returning force is in some embodiments provided through the use of continuous, non-sectioned electrode structures present in the mirrors, the mirrors being inclined or curved to one another along at least a portion of the drift length, preferably most of the drift length. In other embodiments the returning force is provided by electric field components produced by electrically biased compensation electrodes. In particularly preferred embodiments the returning force is provided both by opposing ion optical mirrors being inclined or curved to one another at one end and by the use of biased compensation electrodes. Notably the returning force is not provided by a potential barrier at least as large as the ion beam kinetic energy in the drift direction.

In systems of two opposing elongated mirrors alone, the implementation of a returning force, by, for example one or more electrodes in the X-Z plane at the end of the drift length, or by inclining the mirrors, will necessarily introduce time-of-flight aberrations dependent upon the initial ion beam injection angle, because the electric field in the vicinity of the returning force means cannot be represented simply by the sum of two terms, one being a term for the field in the drift direction ($E_y$) and one being a term for the field transverse to the drift direction ($E_x$). Substantial minimization of such aberrations is provided in the present invention by the use of compensation electrodes, accruing a further advantage to such embodiments.

The time-of-flight aberrations of some embodiments of the present invention can be considered as follows, in relation to a pair of opposing ion optical mirrors elongated in their lengths along a drift direction Y and which are progressively inclined closer together in the X direction along at least a portion of their lengths. An initial pulse of ions entering the mirror system will comprise ions having a range of injection angles in the X-Y plane. A set of ions having a larger Y velocity will proceed down the drift length a little further at each oscillation between the mirrors than a set of ions with a lower Y velocity. The two sets of ions will have a different oscillation time between the mirrors because the mirrors are inclined to one another by a differing amount as a function of the drift length. In preferred embodiments the mirrors are closer together at a distal end from the ion injection means. The ions with higher Y velocity will encounter a pair of mirrors with slightly smaller gap between them than will the ions having lower Y velocity, on each oscillation within the portion of the mirrors which has mirror inclination. This may be compensated for by the use of one or more compensation electrodes. To illustrate this, a pair of compensation electrodes will be considered (as a non-limiting example), extending along the drift direction adjacent the space between the mirrors, comprising extended surfaces in the X-Y plane facing the ion beam, each electrode located either side of a space extending between the opposing mirrors. Suitable electrical biasing of both electrodes by, for example, a positive potential, will provide a region of space between the mirrors in which positive ions will proceed at lower velocity. If the biased compensation electrodes are arranged so that the extent of the region of space between them in the X direction varies as a function of Y then the difference in the oscillation time between the mirrors for ions of differing Y velocity may be compensated. Various means for providing that the region of space in the X direction varies as a function of Y may be contemplated, including: (a) using biased compensation electrodes shaped so that they extend in the +/−X directions a differing amount as a function of Y (i.e. they present a varying width in X as they extend in Y), or (b) using compensation electrodes that are spaced apart from one another a differing amount in Z as a function of Y. Alternatively, the amount of velocity reduction may be varied as a function of Y, by using, for example, using constant width compensation electrodes, each biased with a voltage which varies along their length as a function of Y and again the difference in the oscillation time between the mirrors for ions of differing Y velocity may thereby be compensated. Of course a combination of these means may also be used, and other methods may also be found, including for example, the use of additional electrodes with different electrical biasing, spaced along the drift length. The compensation electrodes, examples of which will be further described in detail, compensate at least partially for time-of-flight aberrations relating to the beam injection angular spread in the X-Y plane. Preferably the compensation electrodes compensate for time-of-flight aberrations relating to the beam injection angular spread in the X-Y plane to first order, and more preferably to second or higher order.

Advantageously, aspects of the present invention allow the number of ion oscillations within the mirrors structure and thereby the total flight path length to be altered by changing the ion injection angle. In some preferred embodiments biasing of the compensation electrodes is changeable in order to preserve the time-of-flight aberration correction for different number of oscillations as will be further described.

In embodiments of the present invention, the ion beam slowly diverges in the drift direction as the beam progresses towards the distal end of the mirrors from the ion injector, is reflected solely by means of a component of the electric field acting in the −Y direction which is produced by the opposing mirrors themselves and/or, where present, by the compensating electrodes, and the beam slowly converges again upon reaching the vicinity of the ion injector. The ion beam is thereby spread out in space to some extent during most of this flight path and space charge interactions are thereby advantageously reduced.

Time-of-flight focusing is also provided by the non-parallel mirror arrangement of some embodiments of the invention together with suitably shaped compensation electrodes, as described earlier; time-of-flight focusing with respect to the spread of injection angles is provided by the non-parallel mirror arrangement of the invention and correspondingly shaped compensating electrodes. Time of flight focusing with respect to energy spread in the X direction is also provided by the special construction of the ion mirrors, generally known from the prior art and more fully described below. As a result of time-of-flight focussing in both X and Y directions, the ions arrive at substantially same coordinate in the Y direction in the vicinity of the ion injector after a designated number of oscillations between the mirrors in X direction. Spatial focussing on the detector is thereby achieved without the use of additional focusing elements and the mass spectrometer construction is greatly simplified. The mirror structures may be continuous, i.e. not sectioned, and this eliminates ion beam scattering associated with the step-wise change in the electric field in the gaps between such sections, especially near the turning point in the drift direction where the ion beam width is at its maximum. It also enables a much simpler mechanical and electrical construction of the mirrors, providing a less complex analyser. Only two mirrors are required. Furthermore, in some embodiments of the invention the time-of-flight aberrations created due to the non-parallel opposing mirror structure may be largely eliminated by the use of compensation electrodes, enabling high mass resolving power to be achieved at a suitably placed detector. Many problems associated with prior art multi-reflecting mass analysers are thereby solved by the present invention.

In a further aspect of the present invention there is provided a method of injecting ions into a time-of-flight spectrometer or electrostatic trap at a first angle +θ to an axis, comprising the steps of: ejecting a substantially parallel beam of ions radially from a storage multipole at a second angle with respect to the said axis and; deflecting the ions by a third angle by passing the ions through an electrostatic deflector, so that the ions then travel into the time-of-flight spectrometer or electrostatic trap, the second and third inclination angles being approximately equal. The present invention further provides an ion injector apparatus for injecting ions into a time-of-flight spectrometer or electrostatic trap at a first angle +θ to an axis, comprising: a storage multipole arranged to eject, in use, ions radially at a second angle with respect to the said axis and; an electrostatic deflector to receive the said ions and deflect, in use, the ions through a third angle so that the ions pass into the time-of-flight spectrometer or electrostatic trap at the first angle +θ to an axis, the second and third inclination angles being approximately equal. Hence the second and third angles are approximately +θ/2. Preferably the time-of-flight spectrometer is a mass spectrometer. The deflector is implemented by any knows means, for example, the deflector may comprise a pair of opposing electrodes. Preferably the pair of opposing electrodes comprise electrodes held a constant distance from each other. The pair of electrodes may be straight, or they may be curved; preferably the pair of electrodes comprises straight electrodes. Preferably the pair of electrodes is biased with a bipolar set of potentials.

The ions are ejected from the storage multipole in a substantially parallel beam and accordingly, a first set of ions ejected from one end of the storage multipole emerge closer to the spectrometer or trap than a second set of ions ejected simultaneously from the other end of the storage multipole, due to the storage multipole inclination angle +θ/2, and accordingly the first set of ions would reach the time-of-flight mass spectrometer or trap before the second set of ions if no deflection means are implemented in between the storage multipole and the spectrometer or trap. The electrostatic deflector compensates the said time-of-flight difference and, simultaneously, doubles the ion beam inclination. To illustrate the time-of-flight compensation, we firstly suppose the ion beam to comprise positive ions, and the first set of ions pass through a first region of the deflector and the second set of ions pass through the second region of the deflector without substantially overlapping inside the deflector. To deflect the positive ions, the electric potential in the first region is more positive, on average, than the electric potential in the second region, which is achieved, for example, by applying a more positive voltage to a first deflecting electrode which is closer to the first region and by applying a less positive voltage to a second deflecting electrode which is nearer to the second region. The average electric potential difference necessarily has two effects: (i) it produces the desired deflecting electric field and (ii) it makes the first set of ions proceed through the deflector more slowly than the second set of ions due to the full energy conservation law—a time-of-flight effect. This time-of-flight effect makes both sets of ions emerge from the deflector to arrive at the time-of-flight spectrometer or electrostatic trap at the same time. The same principles apply were the beam comprising negative ions as the electrostatic deflector potentials would in that case be reversed.

DETAILED DESCRIPTION

Various embodiments of the present invention will now be described by way of the following examples and the accompanying figures.

Figures 1A, 1B:
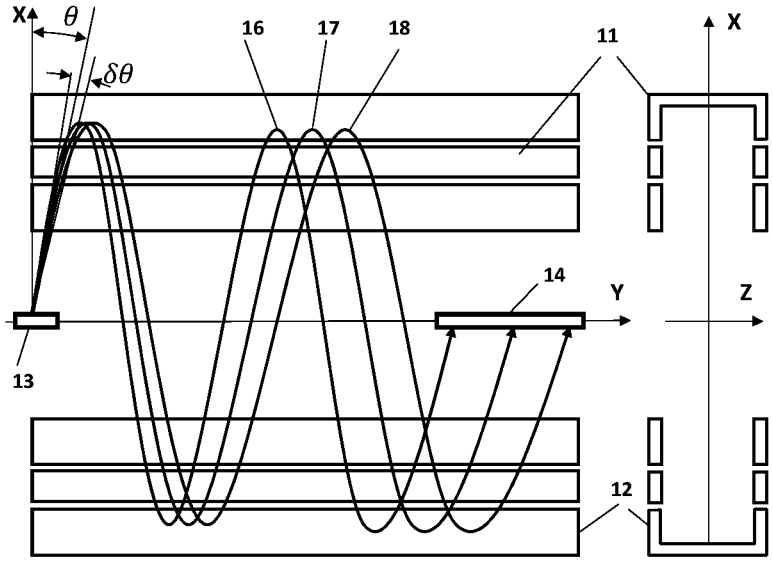
FIG. 1A and FIG. 1B are schematic diagrams of a multi-reflection mass spectrometer comprising two parallel ion-optical mirrors elongated linearly along a drift length, illustrative of prior art analysers, FIG. 1A in the X-Y plane, FIG. 1B in the X-Z plane.

FIG. 1A and FIG. 1B are schematic diagrams of a multi-reflection mass spectrometer comprising parallel ion-optical mirrors elongated linearly along a drift length, illustrative of prior art analysers. FIG. 1A shows the analyser in the X-Y plane and FIG. 1B shows the same analyser in the X-Z plane. Opposing ion-optical mirrors 11, 12 are elongated along a drift direction Y and are arranged parallel to one another. Ions are injected from ion injector 13 with angle $\theta$ to axis X and angular divergence 60, in the X-Y plane. Accordingly, three ion flight paths are depicted, 16, 17, 18.

The ions travel into mirror 11 and are turned around to proceed out of mirror 11 and towards mirror 12, whereupon they are reflected in mirror 12 and proceed back to mirror 11 following a zigzag ion flight path, drifting relatively slowly in the drift direction Y. After multiple reflections in mirrors 11, 12 the ions reach a detector 14, upon which they impinge, and are detected. In some prior art analysers the ion injector and detector are located outside the volume bounded by the mirrors. FIG. 1B is a schematic diagram of the multi-reflection mass spectrometer of FIG. 1A shown in section, i.e. in the X-Z plane, but with the ion flight paths 16, 17, 18, ion injector 13 and detector 14 omitted for clarity. Ion flight paths 16, 17, 18 illustrate the spreading of the ion beam as it progresses along the drift length in the case where there is no focusing in the drift direction. As previously described, various solutions including the provision of lenses in between the mirrors, periodic modulations in the mirror structures themselves and separate mirrors have been proposed to control beam divergence along the drift length. However it is advantageous to allow the ions to spread out as they travel along the drift length so as reduce space charge interactions, so long as they can be brought to some convergence where necessary to be fully detected.

Figure 2:
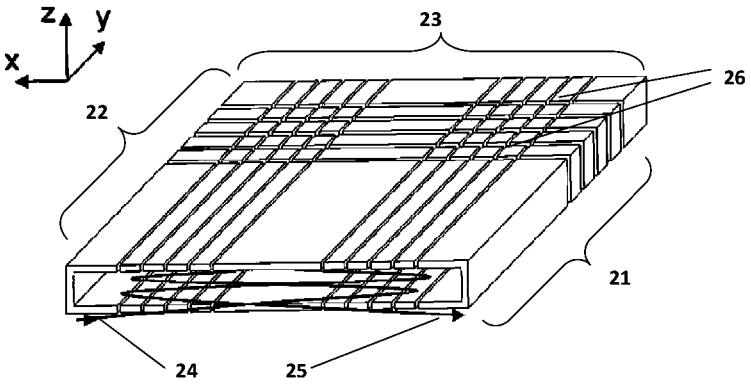
FIG. 2 is a schematic diagram of a prior art multi-reflection mass spectrometer comprising two opposing mirrors comprising sectioned mirror electrodes and a third sectioned-electrode mirror in an orthogonal orientation.

FIG. 2 is a schematic diagram of a prior art multi-reflection mass spectrometer. Sudakov proposed in WO2008/047891 an arrangement of two parallel gridless mirrors 21, 22 further comprising a third mirror 23 oriented perpendicularly to the opposing mirrors and located at the distal end of the opposing mirrors from the ion injector. Ions enter along flight path 24, and after travelling along the drift length are returned back along the drift length by reflection in the third mirror 23 and at the same time beam convergence is induced in the drift direction. Ions emerge along flight path 25. Ion mirror 23 is effectively built into the ends of both opposing mirrors 21, 22, and sections 26 are thereby formed in all three mirrors. The construction of the three mirrors is thereby complicated. The electrical potentials applied to the three mirrors must be distributed to the different sections. The more sections there are, the more complex the structure becomes but the more smoothly the electric field may be distributed in the region in which the ions travel. Nevertheless, the presence of the sections will induce higher electric fields in the regions adjacent gaps between the sections. These fields will be of greater magnitude the simpler the construction of the mirrors. Such electric fields tend to produce ion scattering, as previously described. Ions with higher velocities in the Y direction enter deeper into the third mirror 23 along the Y direction, as was illustrated in relation to FIG. 1A by ion flight paths 16, 17, 18. Accordingly ions with different Y velocities upon injection will cross different numbers of sections, as they proceed different distances into mirror 23. Different ions will thereby suffer different scattering forces and different amounts of scattering forces, producing ion beam aberrations.

Figure 3:
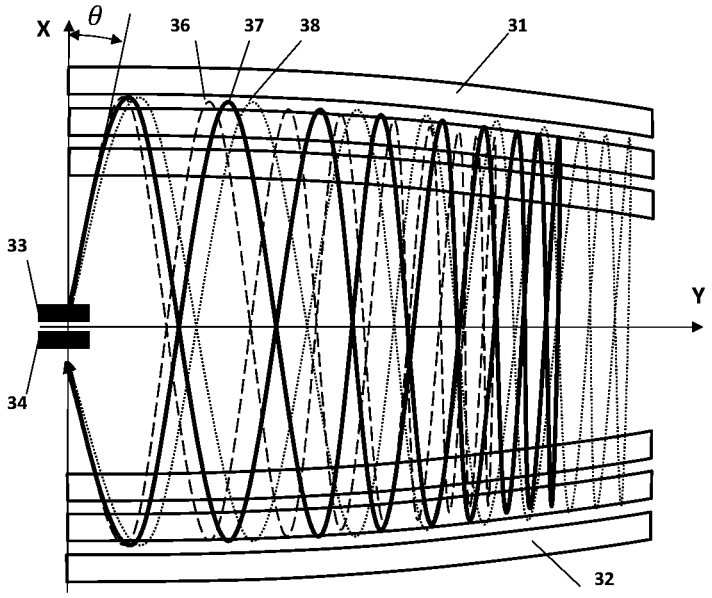
FIG. 3 is a schematic diagram of a multi-reflection mass spectrometer being one embodiment of the present invention, comprising opposing ion-optical mirrors elongated parabolically along a drift length.

One object of the present invention is to provide an elongated opposing ion-mirror structure in which a smooth returning force is produced. FIG. 3 is schematic diagram of a multi-reflection mass spectrometer being one embodiment of the present invention, comprising opposing ion-optical mirrors 31, 32 elongated along a drift length Y and having the shapes of parabolas converging towards each other in the distal end from the ion injector 33. The injector 33 may be a conventional ion injector known in the art, examples of which will be given later. Ions are accelerated by the acceleration voltage V and injected into the multi-reflection mass spectrometer from ion injector 33, at an angle θ in the X-Y plane and with an angular divergence 60, in the same way as was described in relation to FIG. 1. Accordingly three ion flight paths 36, 37, 38 are representatively shown in FIG. 3. As already described, ions are reflected from one opposing mirror 31 to the other 32 a plurality of times whilst drifting along the drift direction away from the ion injector 33 so as to follow a generally zigzag paths within the mass spectrometer. The motion of ions along the drift direction is opposed by an electric field resulting from the non-constant distance of mirrors 31, 32 from each other along their lengths in the drift direction, and the said electric field causes the ions to reverse their direction and travel back towards the ion injector 33. Ion detector 34 is located in the vicinity of ion injector 33 and intercepts the ions. The ion paths 36, 37, 38 spread out along the drift length as they proceed from the ion injector due to the spread in angular divergence 60 as previously described in relation to FIG. 1A, but upon returning to the vicinity of the ion injector 33, the ion paths 36, 37, 38 have advantageously converged again and may conveniently be detected by ion-sensitive surface of detector 34 which is oriented orthogonal to the X axis.

The embodiment of FIG. 3 comprising opposing ion-optical mirrors 31, 32 is an example of the present invention in which parabolic elongation of both mirrors is utilized. As already noted, in embodiments of the present invention the elongation may be linear (i.e. the mirrors are straight, possibly positioned at an angle towards each other), or the elongation may be non-linear (i.e. comprising curved mirrors), the elongation shape of each mirror may be the same or it may be different and any direction of elongation curvature may be the same or may be different. The mirrors may become closer together along the whole of the drift length, or along only a portion of the drift length, e.g. only at a distal end of the drift length of the mirrors from the injector end.

After a pair of reflections in mirrors 31 and 32, the inclination angle changes by the value $\Delta\theta=2\times\Omega(Y)$, where $\Omega=L'(Y)$ is convergence angle of the mirrors with the effective distance L(Y) between them. This angle change is equivalent to the inclination angle change on the $2\times L(0)$ flight distance in the effective returning potential $\Phi_m(Y)=2V[L(0)-L(Y)]/L(0)$. Parabolic elongation $L(Y)=L(0)-AY^2$, where A is a positive coefficient, generates a quadratic distribution of the returning potential in which the ions advantageously take the same time to return to the point of their injection Y=0 independent of their initial drift velocity in the Y direction. The mirror convergence angle Ω(Y) is advantageously small and doesn't affect the isochronous properties of mirrors 31, 32 in the X direction as will be described further in relation to FIGS. 4 and 5. FIG. 3 is an example of one embodiment of the present invention in which both an extended flight path length and spatial focusing of ions in the drift (Y) direction is accomplished by use of non-parallel mirrors. This embodiment advantageously needs no additional components to both double the drift length and induce spatial focusing—only two opposing mirrors are utilised. The use of opposing ion-optical mirrors elongated generally along the drift direction Y such that the mirrors are not a constant distance from each other along at least a portion of their lengths in the drift direction has produced these advantageous properties and these properties are achieved by alternative embodiments in which the mirrors are elongated linearly, for example. In this particular embodiment the opposing mirrors are curved towards each other with parabolic profiles as they elongate away from one end of the spectrometer adjacent an ion injector and this particular geometry further advantageously causes the ions to take the same time to return to their point of injection independent of their initial drift velocity.

Figure 4:
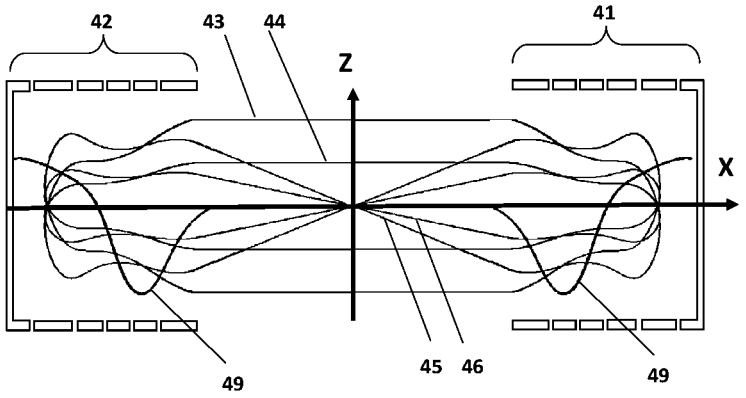
FIG. 4 is a schematic diagram of a section in the X-Z plane of a multi-reflection mass spectrometer comprising two preferred ion-mirrors of the present invention, together with ion rays and potential plots.

FIG. 4 is a schematic diagram of a multi-reflection mass spectrometer comprising two preferred ion-mirrors 41, 42 of the present invention, together with ion rays 43, 44, 45, 46 and electrical potential distribution curves 49. Mirrors 41, 42 are shown in cross section, in the X-Z plane. Each mirror comprises a number of electrodes, and the electrode dimensions, positions and applied electrical voltages are optimized such that the oscillation time, T, of ions between the mirrors, is substantially independent of the ion energy, $\epsilon$, in the interval $\epsilon_0+/-(\Delta\epsilon/2)$, where $\epsilon_0=qV$ is the reference energy defined by the acceleration voltage V and the ion charge q. The ion charge is hereafter assumed positive without loss of generality of the invention's applicability to both positive and negative ions. Electrical potential distribution curve 49 illustrates that each mirror has an accelerating region to achieve spatial focusing of ion trajectories in the X-Z plane parallel (43, 44) to point (45, 46) after a first reflection, and from point to parallel after a second reflection, providing ion motion stability in the X-Z plane. Ions experience the accelerating potential region of the mirror twice on each reflection: once on entry and once on exiting the mirror. As is known from prior art, this type of spatial focussing also helps to eliminate some time-of-flight aberrations with respect to positional and angular spreads in the Z direction.

Figure 5:
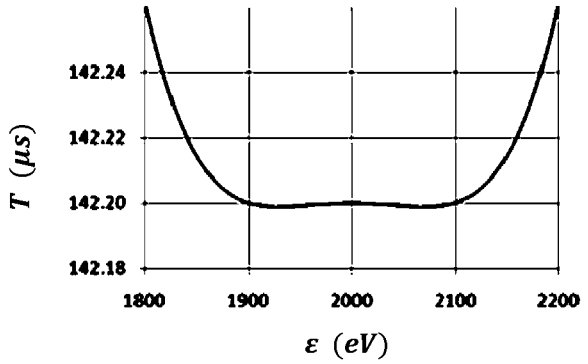
FIG. 5 is a graph of the oscillation time, T plotted against the beam energy, $\epsilon$, calculated for mirrors of the type illustrated in FIG. 4.

As known from the prior art, mirrors of this design can produce highly isochronous oscillation time periods for ions with energy spreads $\Delta\epsilon/\epsilon_0>10\%$. FIG. 5 is a graph of the oscillation time, T plotted against the beam energy, $\epsilon$, calculated for mirrors of the type illustrated in FIG. 4. It can be seen that a highly isochronous oscillation time period is achieved for ions of 2000 eV+/−100 eV. Gridless ion mirrors such as those illustrated in FIG. 4 could be implemented as described in U.S. Pat. No. 7,385,187 or WO2009/081143 using flat electrodes that could be fabricated by well known technologies such as wire-erosion, electrochemical etching, jet-machining, electroforming, etc. They could be also implemented on printed circuit boards.

Figure 6A:
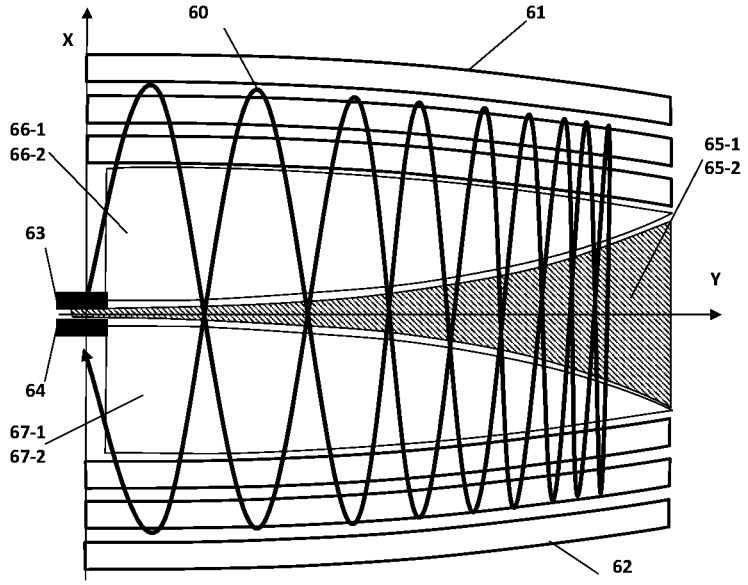
FIG. 6A is a schematic diagram of a multi-reflection mass spectrometer being one embodiment of the present invention, comprising opposing ion-optical mirrors elongated parabolically along a drift length and further comprising parabolically shaped compensation electrodes, some of them biased with a positive voltage.
Figure 6B:
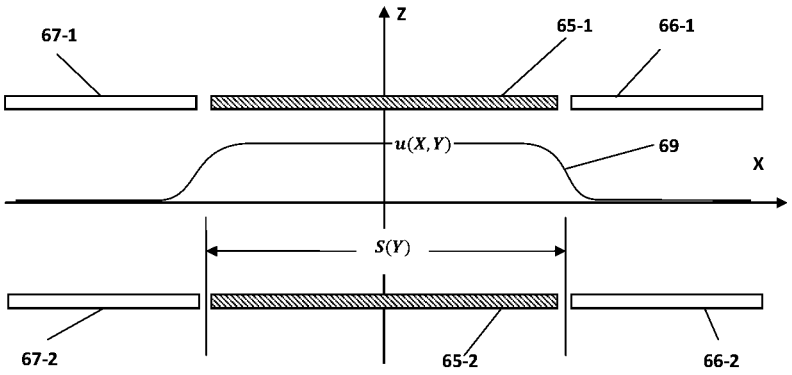
FIG. 6B is a schematic diagram of a section through the spectrometer of FIG. 6A.

FIG. 6A is a schematic diagram of a multi-reflection mass spectrometer being one embodiment of the present invention, comprising opposing ion-optical mirrors elongated parabolically along a drift length, further comprising compensation electrodes. As a more technological implementation, parabolic shapes could be approximated by circular arcs (which could be then made on a turning machine). Compensation electrodes allow further advantages to be provided, in particular that of reducing time-of-flight aberrations. The embodiment of FIG. 6A is similar to that of FIG. 3, and similar considerations apply to the general ion motion from the injector 63 to the detector 64 the ions undergoing a plurality of oscillations 60 between mirrors 61, 62. Three pairs of compensation electrodes 65-1, 65-2 as one pair, 66-1, 66-2 as another pair and 67-1, 67-2 as a further pair, comprise extended surfaces in the X-Y plane facing the ion beam, the electrodes being displaced in +/−Z from the ion beam flight path, i.e. each compensation electrode 65-1, 66-1, 67-1, 65-2, 66-2, 67-2 has a surface substantially parallel to the X-Y plane located either side of a space extending between the opposing mirrors as shown in FIG. 6B. FIG. 6B is a schematic diagram showing a section through the mass spectrometer of FIG. 6A. In use, the compensation electrodes 65 are electrically biased, both electrodes having voltage offset U(Y)>0 applied in case of positive ions and U(Y)<0 applied in case of negative ions. Hereafter we assume the case of positive ions for this and the other embodiments if not stated otherwise. Voltage offset U(Y) is, in some embodiments, a function of Y, i.e. the potential of the compensation plates varies along the drift length, but in this embodiment the voltage offset is constant. The electrodes 66, 67 are not biased and have zero voltage offset. The compensation electrodes 65, 66, 67 have, in this example, a complex shape, extending in X direction a varying amount as a function of Y, the width of biased electrodes 65 in the X direction being represented by function S(Y). The shapes of unbiased electrodes 66 and 67 are complementary to the shape of biased electrodes 65. The extent of the compensation electrodes in the X direction is, in some embodiments, a width that is constant along the drift length, but in this embodiment the width varies as a function of the position along the drift length. The functions S(Y) and U(Y) are chosen to minimize the most important time-of-flight aberrations, as will be further described.

In use, the electrically biased compensation electrodes 65 generate potential distribution u(X,Y) in the plane of their symmetry Z=0, which is shown with schematic potential curve 69 in FIG. 6B. The potential distribution 69 is restricted spatially by the use of the unbiased compensation electrodes 66 and 67. The returning electric field $E_y=-\partial u/\partial Y$ makes the same change of the trajectory inclination angle as the effective potential distribution $\Phi_{ce}(Y)=L(0)^{-1}\int u(X,Y)\,dX\approx U(Y)S(Y)$ averaged over the effective distance between the mirrors L(0). The last approximate equality holds if the separation between the compensation electrodes in Z-direction is sufficiently small. In the embodiment shown in FIGS. 6A and 6B, the compensation electrodes are parabolic in shape, so that $S=BY^2$, where B is a positive constant, and the voltage offset is constant $U=\text{const}\sim V\sin^2\theta<<V$, where V is the accelerating voltage. (The accelerating voltage is with respect to the analyser reference potential.) Therefore, the set of compensation electrodes also generates a quadratic contribution to the effective returning potential, which, being additive with the same sign to the quadratic contribution of the parabolic mirrors, maintains the isochronous properties in drift direction. In embodiments with constant voltage offsets on biased compensation electrodes, the returning electric field $E_y$ is essentially non zero only near the edges of the compensation electrodes, which are non-parallel to the drift axis Y, and the ion trajectories thus undergo refraction every time they cross the edges.

The time-of-flight aberration of the embodiment in FIG. 6A results from two factors: the mirror convergence and the time delay of ions whilst travelling in between the compensation electrodes. When summed up, these two factors give the oscillation time $T(Y)=T(0)\times[L(Y)+S(Y)U/2V]/L(0)$ being a function of drift coordinate. In terms of components of the effective returning potential, $T(Y)-T(0)=T(0)[\Phi_{ce}(Y)-\Phi_m(Y)]/2V$. The coefficients A and B which define the parabolic shapes of the mirrors 61, 62 and the compensation electrodes 65, 66, 67, correspondingly, are preferably chosen in certain proportions to make the components of the returning force equal $\Phi_{ce}(Y)=\Phi_m(Y)$, so that the time per oscillation T(Y) is advantageously constant along the entire drift length and thus eliminates time-of-flight aberrations with respect to the initial angular spread. So, the decrease of the oscillation time at the position distant from the injection point due to the mirror convergence is completely compensated by decelerating the ions while travelling through the region between the compensating electrodes with increased electric potential. In this embodiment, both components of the effective potential contribute equally to the returning force that drives the ion beam back to the point of injection.

The embodiment in FIGS. 6A and 6B can be generalized by introduction of a polynomial representation of the effective returning potential components $\Phi_m=(V \sin^2 \theta)\phi_m$ and $\Phi_{ce}=(V \sin^2 \theta)\phi_{ce}$ where $\phi_m=m_1y+m_2y^2$ and $\phi_{ce}=c_0+c_1y+c_2y^2+c_3y^3+c_4y^4$ are dimensionless functions of dimensionless normalized drift coordinate $y=Y/Y_0^*$, and $Y_0^*$ is the designated drift penetration depth of an ion with mean acceleration voltage V and mean injection angle θ. Therefore, the sum of coefficients $m_1+m_2+c_1+c_2+c_3+c_4$ equals to 1 by definition. Consider an ion which reaches its turning point in drift direction $Y=Y_0$ that is a function of the ion's injection angle $\theta+\Delta\theta$ defined by condition $\phi_m(y_0)+\phi_{ce}(y_0)-c_0=\sin^2(\theta+\Delta\theta)/\sin^2\theta$, where $y_0=Y_0/Y_0^*$ is the normalized turning point coordinate. The return time taken for this ion to come back to the injection point Y=0 is proportional to integral $$\tau(y_0) = \frac{2}{\pi}\int_0^{y_0} \frac{dy}{\sqrt{[\varphi_m(y_0)+\varphi_{ce}(y_0)]-[\varphi_m(y)+\varphi_{ce}(y)]}}$$

whilst the time-of-flight offset of the moment when an ion with given normalized turning point coordinate $y_0$ impinges the detector's plane X=0 after a designated number of oscillations between the mirrors is proportional to integral $$\sigma(y_0) = \frac{2}{\pi}\int_0^{y_0} \frac{\varphi_{ce}(y)-\varphi_m(y)}{\sqrt{[\varphi_m(y_0)+\varphi_{ce}(y_0)]-[\varphi_m(y)+\varphi_{ce}(y)]}}dy.$$

The deviation of function $\sigma(y_0)$ from $\sigma(1)$ thus determines the time-of-flight aberration with respect to the injection angle.

Figure 6C:
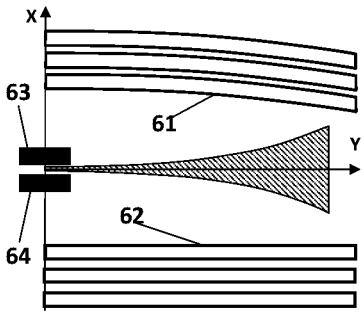
FIGS. 6C and 6D illustrate analogous embodiments with asymmetrical shapes of the mirrors.
Figure 6D:
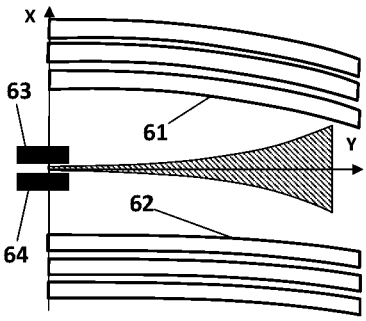

Values of the coefficients m and c are to be found from the following conditions: (1) the integral σ is substantially constant (not necessarily zero) in the vicinity of $y_0=1$, which corresponds to slow time-of-flight dependence on the injection angle in the interval $\theta\pm\delta\theta/2$, and (2) the integral τ has vanishing derivative $\tau'(1)$ to ensure at least first-order spatial focusing of the ions on the detector. The embodiment represented schematically in FIG. 6A with parabolic mirrors and parabolic compensation electrodes corresponds to the values of coefficients m and c as in the first column in Table 1. Since the effective returning potential is quadratic, $\tau(y_0)\equiv1$ and the ion beam is ideally spatially focused onto the detector. At the same time, $\sigma(y_0)\equiv0$ which corresponds to complete compensation of the time-of-flight aberration with respect to the injection angle. Alternative embodiments may compromise these ideal properties for the sake of mirror fabrication feasibility. A preferred embodiment comprising only straight mirrors elongated along the drift direction and tilted towards each other with a small convergence angle Ω is a particular case, straight mirrors being more easily manufactured than curved mirrors (or even circular arcs). The embodiments with straight mirrors are characterized by linear dependence of the $\Phi_m$ component of the effective returning force, therefore the coefficients $m_1>0$ and $m_2=0$. Curved mirrors might be asymmetric as shown for example in FIG. 6C and FIG. 6D, with one mirror 62 being straight (FIG. 6C) or both mirrors may be curved in the same direction (FIG. 6D). In both cases, however, separation between the mirrors at the distal end is smaller than separation between the mirrors at the end next to the injector 63 and detector 64. These examples are only some of the possible mirror arrangements which may be utilised with the present invention.

Figure 7A:
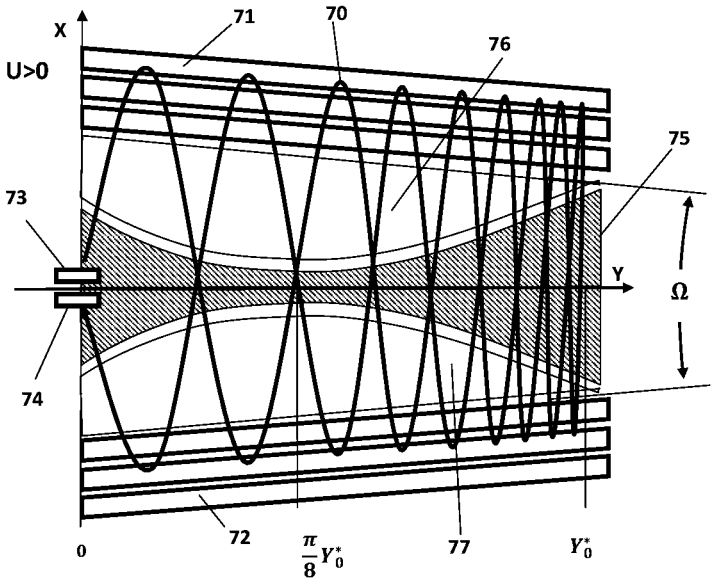
FIGS. 7A and 7B are schematic diagrams of multi-reflection mass spectrometers being embodiments of the present invention, comprising opposing ion-optical mirrors elongated linearly along a drift length and arranged at an inclined angle to one another, further comprising compensation electrodes with concave (FIG. 7A) and convex (FIG. 7B) parabolic shape.

FIG. 7A is schematic diagram of a multi-reflection mass spectrometer being one embodiment of the present invention, comprising opposing straight ion-optical mirrors 71, 72 elongated along a drift length and tilted by small angle Ω towards each other. The coefficients m and c are as presented in the second column in Table 1. The linear part of the total effective returning potential $\Phi=\Phi_m+\Phi_{ce}$ is zero because $m_1=-c_1$, and Φ is a quadratic function of the drift coordinate (save for the inessential constant resulting from $c_0$). Therefore exact spatial focusing of the ion beam 70 originating from injector 73, takes place on the detector 74. The value of coefficient $c_0$ may be an arbitrary positive value greater than $\pi^2/64$ to make the width function S(Y) of positively biased (in the case of positively charged ions) compensation electrodes 75 strictly positive along the drift length. The narrowest part of the biased compensation electrodes 75 is located at the distance $(\pi/8)\times Y_0^*$ from the point of ion injection. Two pairs of unbiased compensation electrodes 76 and 77 have their shapes complementary with the shapes of electrodes 75 and. serve to terminate the electric field from the biased compensation electrodes 75.

TABLE 1

Figure 7B:
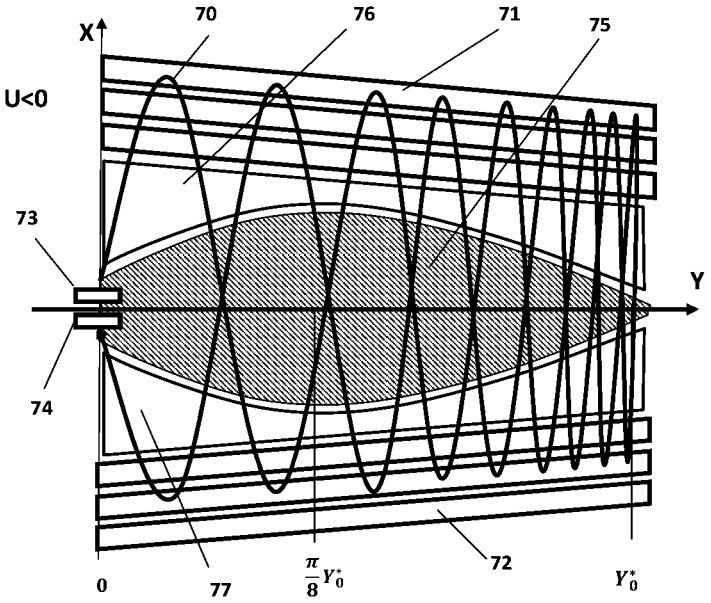
Figure 9:
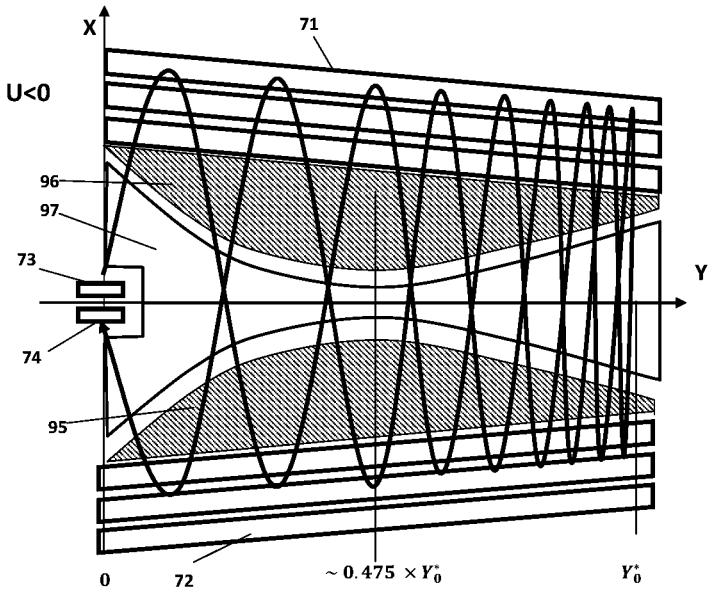
FIG. 9 is a schematic diagram of a multi-reflection mass spectrometer being one embodiment of the present invention, comprising opposing ion-optical mirrors elongated linearly along a drift length and arranged at an inclined angle to one another, further comprising compensation electrodes.

| | | Embodiments | | | |
|---|---|---|---|---|---|
| | | FIG. 6A | FIG. 7A | FIG. 7B | FIGS. 9 |
| Mirrors | shape | Parabolic | Straight | Straight | Straight |
| | $m_1$ | 0 | π/4 | π/4 | 1.211 |
| | $m_2$ | ½ | 0 | 0 | 0 |
| Compensation electrodes | shape | Concave parabola | Concave parabola | Convex parabola | 4th-order polynomial |
| | Voltage offset (for positive ions | U > 0 | U > 0 | U < 0 | U < 0 |
| | $c_0$ | 0 | > $\pi^2/64$ | > π/4-1 | 0 |
| | $c_1$ | 0 | −π/4 | −π/4 | −4.111 |
| | $c_2$ | ½ | 1 | 1 | 5.260 |
| | $c_3$ | 0 | 0 | 0 | −1.217 |
| | $c_4$ | 0 | 0 | 0 | −0.143 |

FIG. 7B is schematic diagram of a multi-reflection mass spectrometer similar to that shown in FIG. 7A, with like components having like identifiers, but with negative offset U<0 on the biased compensating electrodes 75 (in case of positively charged ions). The choice of coefficient $c_0<\pi/4-1$ makes the dimensionless function $\phi_{ce}(y)<0$ along the whole drift length, so that the electrode width S(Y) is strictly positive. In this embodiment, the biased compensating electrodes 75 have convex parabolic shapes with their widest parts located at the distance $(\pi/8)\times Y_0^*$ from the point of ion injection.

The value of the mirror convergence angle is expressed through the coefficient $m_1=\pi/4$ with formula $\Omega=m_1L(0)\sin^2\theta/2\ Y_0^*$. With the effective distance between the mirrors L(0) being comparable with the drift distance $Y_0^*$; and the injection angle $\theta=50$ mrad, the mirror convergence angle can be estimated as $\Omega\approx1$ mrad$<<\theta$. Therefore, FIGS. 7A and 7B, FIG. 9, FIG. 11A, FIG. 11B, FIG. 13 and FIG. 15 show the mirror convergence angle, and other features, not to scale.

Figure 7C:
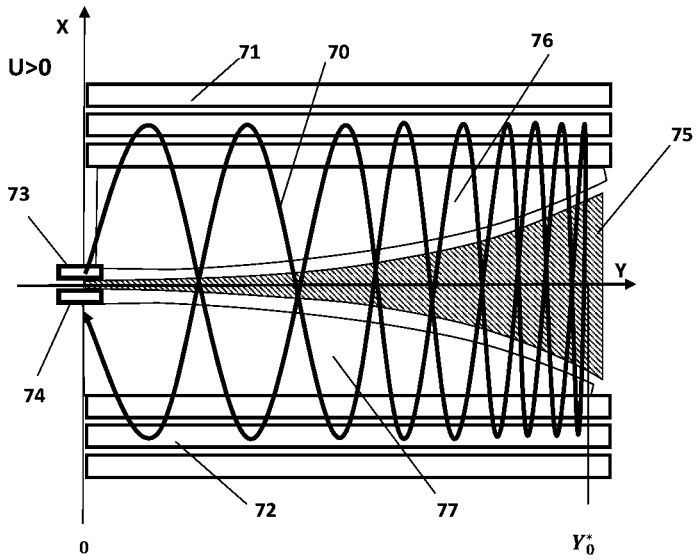
FIG. 7C is a schematic diagram of further multi-reflection mass spectrometer being an embodiment of the present invention, comprising opposing ion-optical mirrors elongated linearly along a drift length and arranged parallel to one another, further comprising parabolic compensation electrodes.

FIG. 7C is a schematic diagram of a multi-reflection mass spectrometer similar to that shown in FIG. 7A, with like components having like identifiers, but with zero convergence angle, i.e. $\Omega=0$. This is an example of a mass spectrometer comprising two opposing ion-optical mirrors elongated generally along a drift direction (Y), each mirror opposing the other in an X direction and having a space therebetween, the X direction being orthogonal to Y, the mirrors being a constant distance from each other in the X direction along the whole of their lengths in the drift direction. In this embodiment, the opposing mirrors are straight and arranged parallel to each other. Compensation electrodes similar to those already described in relation to FIG. 6A extend along the drift direction adjacent the space between the mirrors, each electrode having a surface substantially parallel to the X-Y plane, and being located either side of the space extending between the opposing mirrors, the compensation electrodes being arranged and biased in use so as to produce an electric potential offset having a different extent in the X direction as a function of the distance along the drift length. The coefficient $c_2=1$ for this embodiment, and the other coefficients m and c vanish. The biased compensation electrodes produce a quadratic distribution of the total effective returning potential $\Phi(Y)=\Phi_{ce}(Y)$, therefore, exact spatial focusing of the ion beam 70 originating from injector 73, takes place on the detector 74. The value of coefficient $c_0$ may be an arbitrary positive value. Two additional pairs of unbiased compensation electrodes similar to electrodes 76 and 77, having their shapes complementary with the shape of biased compensation electrodes 75, serve to terminate the field from compensation electrodes 75. In this embodiment the compensation electrodes 75 are electrically biased to implement isochronous ion reflection in the drift direction; however, the time-of-flight aberrations with respect to the injection angle are not compensated.

In a similar manner, a multi-reflection mass spectrometer similar to that shown in FIG. 7B may be formed, but once again with zero convergence angle, i.e. $\Omega=0$. In this embodiment, biased compensating electrodes have convex parabolic shape with negative offset $U<0$ applied to implement isochronous ion reflection in the drift direction.

Figure 8:
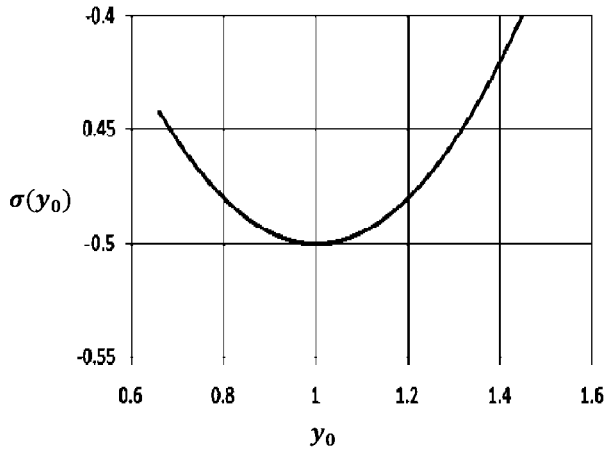
FIG. 8 is a graph of normalized time-of-flight offset versus normalized coordinate of the turning point related to the mass spectrometer depicted in FIGS. 7A and 7B.

The embodiments in FIGS. 6A and 7A-7C possess ideal spatial focusing on the detector, which means that $\tau(y_0)$=const and, therefore, the return time in the drift direction is completely independent of the injection angle. The embodiments with linearly elongated mirrors in FIGS. 7A and 7B provide, however, only first-order compensation of the time-of-flight aberration. FIG. 8 shows normalized time-of-flight offset $\sigma(y_0)$ versus normalized coordinate of the turning point, which is the same for the embodiments in FIGS. 7A and 7B. The minimum of this function in the point $y_0=1$, where $\sigma=0.5$ and $\sigma'=0$, realizes only first-order compensation of the time-of-flight aberration with respect the injection angle $\theta$, whilst the second derivative $\sigma''(1)>0$, which makes the time-of-flight spread proportional to $\delta\theta^2$.

Figure 10:
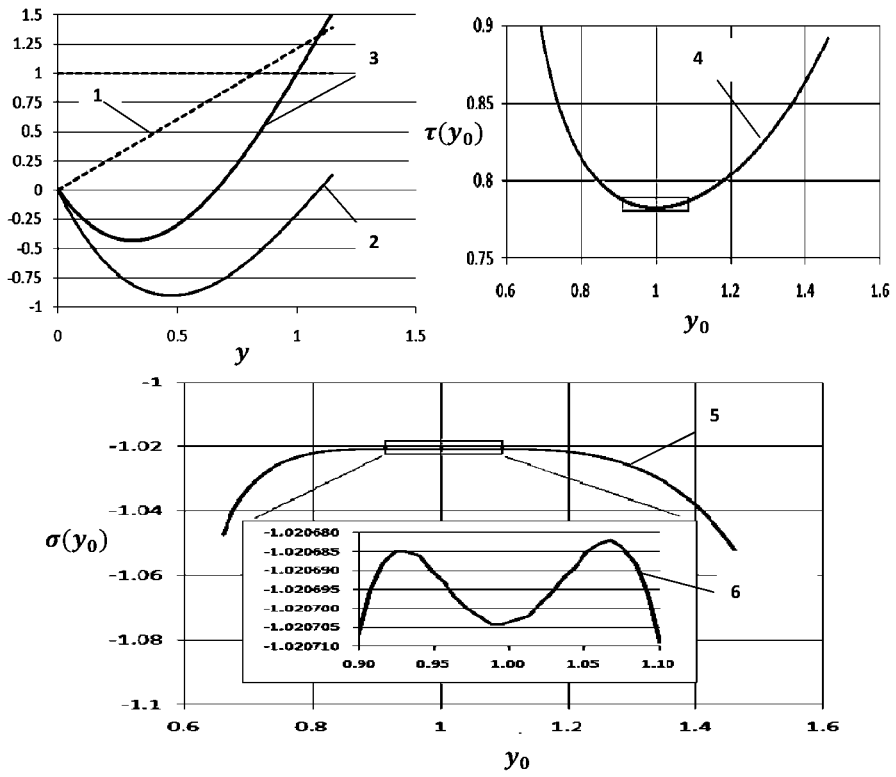
FIG. 10 shows principal characteristic functions related to the embodiment depicted in FIG. 9 with optimized time-of-flight aberrations.

Ideal spatial focusing, however, can be compromised in order to achieve better compensation of the time-of-flight aberration, that is make the integral $\sigma(y_0)$ as constant as possible in the vicinity of $y_0=1$ even in the case of linearly elongated mirrors. An embodiment in FIG. 9 comprises two straight ion mirrors 71, 72 elongated in drift direction and tilted towards each other, ion injector 73, ion detector 74, and three pairs of complex-shaped compensation electrodes 95, 96, 97. Coefficients $c_{0\text{-}4}$ given in the fourth column in Table 1 define the forth-order polynomial $\phi_{ce}$ which is negative along the entire drift length as shown in FIG. 10. The sum of the widths of biased compensation electrodes 95 and 96 is proportional to $-\phi_{ce}$ and these electrodes are biased negatively (in case of positively charged ions). The embodiment depicted in FIG. 9 thus comprises biased compensation electrodes separated in two parts 95 and 96 that are located next to the mirrors 71 and 72, which advantageously leaves more space for ion injector 73, ion detector 74, and other elements which can be placed between the mirror 71 and 72. The individual widths of compensation electrodes 95 and 96 may, in some embodiments, differ from each other, or may be equal as in the embodiment in FIG. 9. The widest part of the electrodes 95, 96 is located at the distance approximately $4.75\times Y_m$ from the point of ion injection. Compensation electrodes 97 have their shapes complimentary to the shape of electrodes 95, 96 and are not biased.

FIG. 10 shows dimensionless components of the effective returning potential in the embodiment shown in FIG. 9. Distribution of $\phi_m(y)$ (trace 1) is a linear function of normalized drift coordinate, which corresponds to action of straight tilted ion mirrors. Distribution of $\phi_s$ (trace 2) is negative along the whole drift length and can be realized with negatively biased compensating electrodes 95, 96 shown in FIG. 9. Trace 3 in FIG. 11 is the sum of said components $\phi_m+\phi_s$ as function of y. It is noteworthy that the effective returning potential accelerates the ions in the drift direction whilst they travel approximately the first one third of the full drift length and only then decelerating starts. The effective returning potential distribution is proportional to trace 3 and ensures first-order independence of the return time on the normalized turning point coordinate $y_0$ in the drift direction and, correspondingly, on the injection angle. This corresponds to vanishing first-order derivative $\tau'(1)=0$ of the function $\tau(y_0)$ shown as trace 4. It should be noted that exact independence of the return time on the injection angle is not necessary. The condition to be satisfied is that the ion beam is focused onto a portion of detector which is less than the distance between the injection point and the point where the ion beam comes back to the plane X=0 after the first reflection in the mirror 71 in FIG. 9. This length is estimated as $L(0)\sin\theta$, and therefore non-ideality of spatial focusing imposes a lower limit on the injection angle $\theta$ and, correspondingly, an upper limit on the number of reflections. Eventually, the number of reflections should be no more than 62 for the relative injection angle spread $\delta\theta/\theta=20\%$ in the embodiment of FIG. 9, which is quite advantageous. The maximum number of oscillations may be increased with the relative injection angle spread decreasing. Compromised spatial focusing onto the detector allows better compensation of the time-of-flight aberration in the embodiment in FIG. 9. Traces 5 and 6 in FIG. 10 show the function $\sigma(y_0)$ that reveals a wide plateau in the interval $0.9\le y_0\le1.1$ which provides practically complete compensation of the time-of-flight aberration for at least $\delta\theta/\theta=20\%$ relative injection angle spread.

The drift length $Y_m^*$ and injection angle $\theta$ should be chosen to define a designated number of full oscillations $K=\pi\tau(1)Y_m^*/(2L(0)\tan\theta)$ (each full oscillation comprises two reflections in the opposing mirrors) before the ions drift back to the point of their origin Y=0. The coefficient $\tau(1)=1$ for the embodiments depicted in FIGS. 6A, 7A, 7B; and $\tau(1)=0.783$ for the embodiment of FIG. 9 (which corresponds to the minimum of trace 4 in FIG. 10). The number of full oscillations K is preferably an integer. In order to increase K and, correspondingly, the total effective flight length, the reference incidence angle $\theta$ should be made as small as possible and the drift length $Y_m$ should be made as large as possible. The value of $\theta$ is practically restricted by the initial ion beam angular spread $\delta\theta$ to keep the ratio $\delta\theta/\theta$ small enough (e.g. less than 20%), and the minimal separation $L(0)\sin\theta$ between the ion trajectories on the first and second half-reflection required to physically accommodate the ion source and detector. The drift length $Y_m$ is limited in practical terms by the vacuum chamber dimensions, which are preferably less than 1 m in both X and Y directions to reduce the cost of vacuum chamber and pumping components.

Figure 11A:
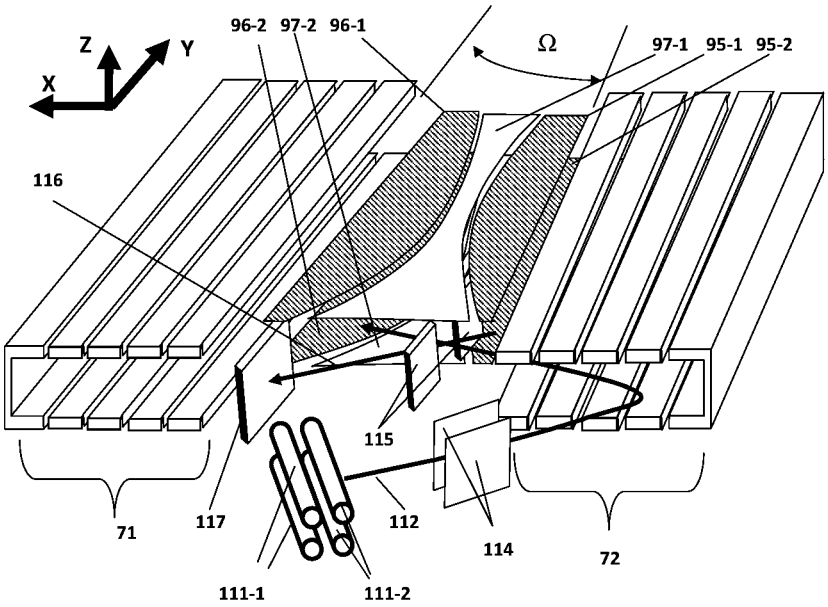
FIG. 11A is a schematic perspective view of a multi-reflection mass spectrometer according to the present invention similar to that depicted in FIG. 9, further comprising ion injection and detection means.
Figure 11B:
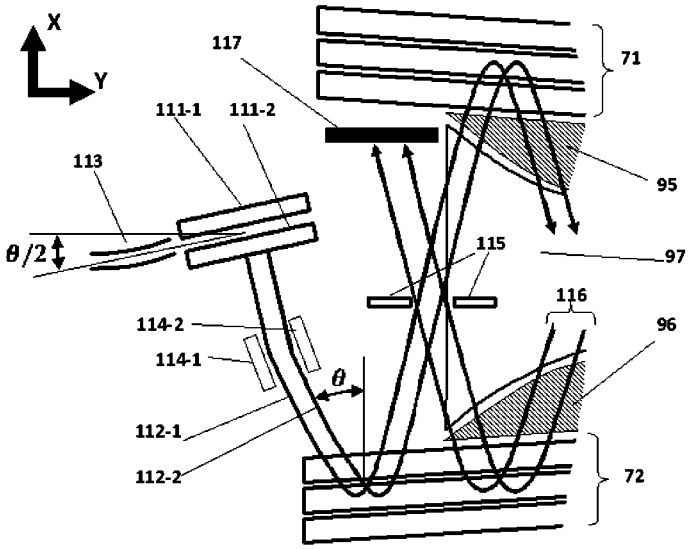
FIG. 11B is a schematic diagram of the entrance end of the spectrometer of FIG. 11A.

FIGS. 11A and 11B depict preferred injection and detection methods for the embodiment shown in FIG. 9. FIG. 11B shows only the entrance region of the embodiment of FIG. 11A. The embodiment in FIGS. 11A and 11B comprises elements of embodiment in FIG. 9, including mirrors 71, 72 and pairs of compensation electrodes 95, 96, 97. Like elements have like identifiers. This embodiment further comprises RF storage multipole 111, deflector 114, and ion detector 117. Ions enter the storage multipole 111 in the plane of the FIG. 11B from the ion guide 113 (not shown in FIG. 11A) and are stored in it whilst at the same time losing their excessive energy (becoming thermalised) in collisions with a bath gas (preferably nitrogen) contained within the multipole 111. After a sufficient number of ions are accumulated, the RF is switched off as described in WO2008/081334 and a bipolar extraction voltage is applied to all or some electrodes of the storage multipole to eject the ions 112 towards mirror 72. For example, electrodes 111-1 are pulsed positively and/or electrodes 111-2 are pulsed negatively. Upon ejection the ions are accelerated by the acceleration voltage V, preferably in the range 5-30 kV.

Alternatively, an orthogonal ion accelerator can be used to inject the ion beam into the mass spectrometer as described in the U.S. Pat. No. 5,117,107 (Guilhaus and Dawson, 1992).

Ion bunch 112 undergoes an extra reflection in mirror 72 (i.e. undergoes a non-integer number of full oscillations between mirrors 71, 72) which advantageously allows more space for the storage multipole 111. A system of lenses (not shown) can be used to conjugate emittance of the storage multipole and acceptance of the mass spectrometer. A diaphragm 115 preferably shapes the ion beam before injection to the mass spectrometer and prior to detection. Due to low time-of-flight aberrations with respect to initial ion spread in drift direction, ion extraction from a long length of the storage multipole 111 is possible, which advantageously reduces space-charge effects.

The long axis of the storage multipole 111 lies in the plane of mass spectrometer but may be non-parallel to the drift axis Y and preferably constitutes angle $\theta/2$ with this axis. After ejection from storage multipole 111 and upon acceleration, a substantially parallel beam of ions enter deflector 114 which turns trajectories 114 by a further angle $\theta/2$ to constitute the designated injection angle $\theta$ (preferably 10-50 mrad). Deflector 114 may be implemented by any known means, e.g. as a pair of parallel electrodes 114-1 and 114-2, as shown in FIG. 11B, the electrodes being biased with bipolar voltage having potentials equally biased either side of the spectrometer potential. This injection scheme advantageously compensates the time-of-flight differences between ions which originated from different parts of the storage multipole 111. Ions 112-1 emerge during ejection from the storage multipole closer to mirror 72 than ions 112-2 that have same mass and charge, and thus ions 112-1 propagate ahead of the ions 112-2 before both groups of ions enter deflector 114. Inside the deflector, ions 112-1 are decelerated by the electric field of positively biased electrode 114-1. On the contrary, ions 112-2 enter the deflector 114 near negatively biased electrode 114-2 and, therefore, travel through the deflector faster. As results, both groups of ions enter mirror 72 substantially simultaneously. This ion injection scheme may be utilised with prior art mass spectrometers, being particularly suitable for elongated opposing mirror arrangements. This ion injection scheme does not depend upon the mirror inclination angle $\Omega$ nor upon the presence of compensation electrodes and hence may be used with parallel mirror arrangements of the present invention and those of the prior art.

As the ion beam approaches the distal end of mirrors 71, 72, the beam's angle of inclination in the X-Y plane gets progressively smaller until its sign is changed in the turning point (not shown) and the ion beam starts its return path towards detector 117. The ion beam width in the Y dimension reaches its maximum near the turning point and the trajectories of ions having undergone different numbers of oscillations overlap thus helping to average out space charge effects. The ions 116 come back to the detector 117 after designated integer number of full oscillations between mirrors 71 and 72. Diaphragm 115 may be used to limit the size of the beam in Y, if necessary. The sensitive surface of the detector 117 is preferably elongated in the drift direction parallel to the drift axis Y. Microchannel or microball plates as well as secondary electron multipliers could be used for detection. In addition, in a known manner post-acceleration (preferably by 5-15 kV) could be implemented prior to detection for better detection efficiency for high mass ions.

Compensation electrodes 95, 96 comprise two parallel electrodes displaced from the X-Y plane in the +/−Z directions (above and below the plane of ion motion). Compensation electrodes 95, 96 are provided with a voltage offset U (preferably of order of magnitude $V\sin^2\theta$) and have their shapes defined by the fourth order polynomial with the coefficients $c_0 \ldots c_4$ as described in relation to embodiments in FIG. 9. Compensation electrodes 95, 96, 97 could be implemented as a laser-cut metal plate supported by dielectrics, or a printed-circuit board (PCB) with appropriately shaped electrodes. More than one voltage could be used in the latter case. Preferably the compensation electrodes 95-1, 96-1, 97-1 are separated from compensation electrodes 95-2, 96-2, 97-2 by several times the maximum Z-height of the ion beam as it passes between the compensation electrodes, e.g. the compensation electrodes are separated by 20 mm and the maximum beam height in the Z dimension is 0.7 mm. This reduces the variation in electric field produced by the compensation electrodes over the beam height.

The embodiment in FIGS. 11A and 11B was simulated numerically. The ions of mass/charge ratio m/z=200 a.m.u. are accumulated in the storage multipole 111 and stored along an axial length of 10 mm. Upon thermalization, the ions are extracted orthogonally to the multipole axis with electric field $E_0 \approx 1500$V/mm and accelerated by the accelerating voltage V=5 kV. Upon acceleration, the ions enter the mirrors 72 with the spread of injection angles $\delta\theta \approx 0.01$ rad which is completely due to the initial thermal velocity spread in the storage multipole. The principal or mean trajectory travels $Y_0^*=0.6$ m in the drift direction before being turned around to travel back towards the detector which is located in the region of the ion injector, during which K=25 full oscillations are performed between the opposing mirrors. The ion beam width in the drift direction increases from an initial width ~10 mm up to ~75 mm near the turning point thus significantly reducing the space-charge density in the beam. During the backward drift towards the detector 117, the ion beam is compressed almost down to its initial width.

The optimal injection angle is $\theta=\text{atan}(\pi\tau(1)Y_0^*/2KL(0))\approx 2.64$ degrees, where $L(0)\approx 0.64$ m is the effective distance between the opposing mirrors in the vicinity of the ion injector. One half of this angle results from the inclination of the storage multipole 111, and the second half results from the deflection by deflector 112. The effective flight length is about $(2K+1)L(0)\approx 32.6$ m (including one extra reflection as shown in FIG. 11B) which is covered by the ions with mass/charge ratio m/z=200 a.m.u. during approximately $T_{total}=470$ μs. Time-of-flight separation of ions with different mass-to-charge ratios occurs during the flight length; and the signal from the detector carries, as a function of time, information about mass spectrum of the analysed ions.

Figure 11C:
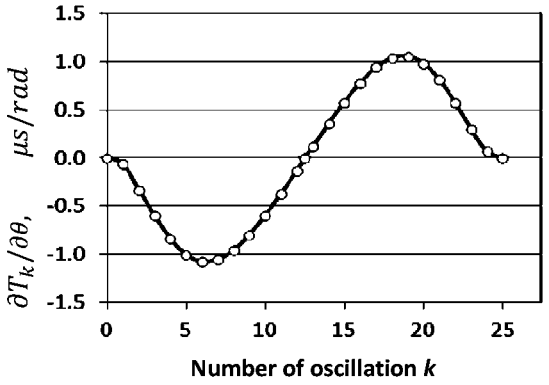
FIGS. 11C and 11D illustrate results of numerical simulation of the embodiment shown in FIGS. 11A and 11B.
Figure 11D:
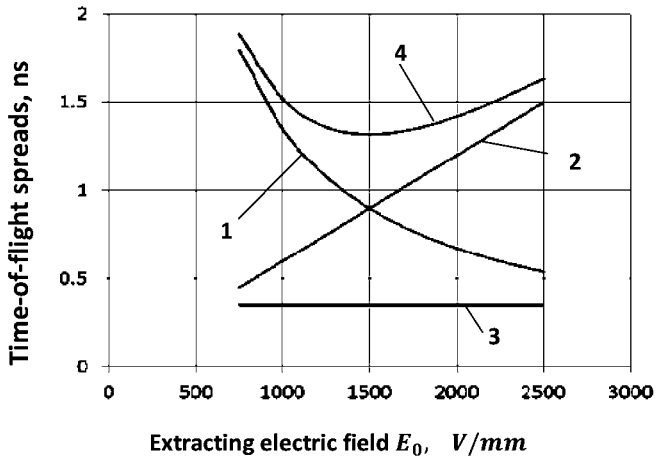

For the parameters as above, the optimal mirror inclination angle is $\Omega=m_1\ [L(0)/2Y_0^*]\ \tan^2\theta=0.0787$ degrees, where $m_1=1.211$ in agreement with column 4 of Table 1. Such an inclination angle corresponds to a mirror convergence by the amount of $\Delta L=L(Y_0^*)-L(0)=\Omega Y_0^*\approx 0.88$ mm at the distal end of the drift region, and, in the absence of the compensation electrodes, the relative time-of-flight difference between two trajectories with the injection angles separated by $\delta\theta/\theta\approx 20\%$ could be estimated as $(\delta\theta/\theta)\times\Delta L/L(0)\approx 3\times 10^{-4}$ with corresponding resolving power limited to the value $0.5/3\times 10^{-4}\approx 1600$. The total width of the biased compensation electrodes 95 and 96 was chosen in agreement with present invention as a fourth-order polynomial $S(y)=W[c_1y+c_2y^2+c_3y^3+c_4y^4]$, where W=0.18 m, $y=Y/Y_0^*$, and coefficients c are as in column 4 of Table 1. The optimal voltage offset on the biased compensation electrodes 95 and 96 is $U=-L_0V\tan^2\theta/W=-37.8$ V. In the presence of the biased compensation electrodes, the period of oscillation is not constant along the drift length but varies between approximately 18.495 us and 18.465 μs. The properly chosen profile of the compensation electrodes makes, however, the first-order time of flight aberration $\partial T_k/\partial\theta$ to vanish after all K=25 oscillations are completed as shown in FIG. 11C ($T_k$ is here the time of particle arrival at the plane X=0 upon the k-th oscillation). The higher-order aberrations are also made sufficiently small.

The complete set of third order aberrations with respect to three initial coordinates and three initial velocity components was calculated to estimate the resolving power of the mass spectrometer. The time-of-flight spread δT of the ions with same mass and charge upon impinging the detector 117 is due to three major factors, simulated values of which are presented separately in FIG. 11D as functions of the extracting field $E_0$. Trace 1 shows the turn-around time spread which is proportional to the thermal velocity spread of the stored ions in the multipole and is inversely proportional to $E_0$. Trace 2 shows contribution from the mirror aberrations, which is proportional to the number of oscillations and linearly grows with the energy spread in the ion beam, which is, in its turn, proportional to $E_0$. Trace 3 shows contribution of time-of-flight aberrations with respect to the spread of injection angles and positional spread along the storage multipole ($E_0$—independent), and which is subject to minimization in the present invention. The total time-of-flight spread δT defined as square root of the sum of squares of said contributions, is illustrated by Trace 4. As a function of $E_0$, the total time-of-flight spread has a minimum $\delta T_{min}\approx 1.3$ ns at the optimal value of extracting field $E_0\approx 1500$V/mm. The mass spectrometer's resolving power can be thus estimated as $T_{total}/2\delta T_{min}\approx 180\ 000$. The biased compensation electrodes increase, therefore, the spectrometer's mass resolving power by factor ~100.

Figure 12A:
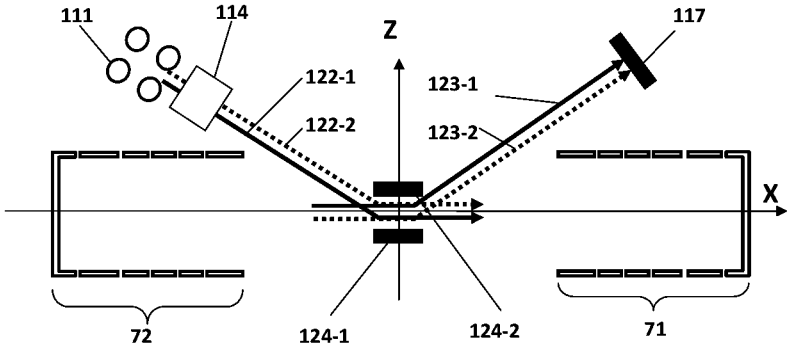
FIGS. 12A and 12B are schematic sectional diagrams of the multi-reflection mass spectrometer of FIG. 11A showing two different means for injection and detection of ions in which ion injectors and ion detectors lie outside the X-Y plane of the spectrometer.
Figure 12B:
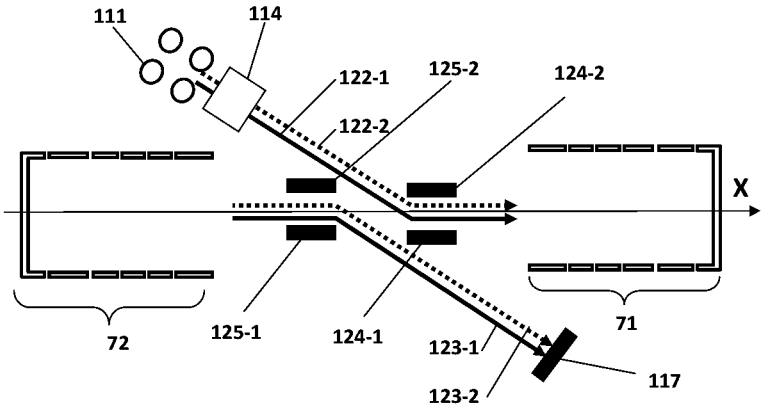

Both storage multipole 111 and detector 117 could be separated from the plane of symmetry of the mirrors (Z=0) and ions be directed into and out of this plane using known deflection means. FIGS. 12A and 12B are alternative variants of ion injection and detection for the embodiment in FIGS. 11A and 11B, like identifiers denote like elements. The ion injection means, comprising RF storage multipole 111 and deflector 114, generate ion bunch 122 inclined with respect to the X-Y plane of analyzer. Deflector 124 which comprises two electrodes 124-1 and 124-2 biased with a bipolar voltage, is positioned downstream in the plane of mass spectrometer and deflects the ions 122 towards mirror 71. Known time-of-flight aberrations are introduced upon deflection. Indeed, ions 121-1 undergo a longer path than ions 122-2 and are further decelerated in the vicinity of a positively biased deflection electrode 124-1. Therefore, ions 122-1 enter mirror 71 with a certain time delay with respect to ions 122-2; and the angular spread of the injected ions make the situation even more complicated. However, an advantageous property of the mirrors 71, 72 is to focus the ion beam from parallel to point (in the X-Z plane) after each reflection and change the signs of the coordinate Z and velocity component $\dot{Z}$ to opposite after each full oscillation that comprises two reflections as shown in FIG. 4.

FIG. 12A illustrates the injection/detection method in case of an odd number of full oscillations between mirrors 71, 72. The value of Z and $\dot{Z}$ upon return to deflector 124 are opposite to those during injection, and deflector 124 introduces opposite time-of-flight shifts to each ion comprising the bunch. Therefore all ions with same mass and charge ejected from the storage multipole 111 arrive at the detector 117 also substantially simultaneously.

FIG. 12B illustrates the injection/detection arrangement in the case of an even number of full oscillations between mirrors 71, 72. Extra deflector 125 is introduced in the X-Y plane of the mass spectrometer next to deflector 124. Deflector 125 is preferably identical to deflector 124 but has its electrodes biased in opposite polarity to incline the ion trajectories 123 at an angle equal but opposite to the angle of injection in the X-Z plane. With the number of full oscillations being even, the value of Z and $\dot{Z}$ upon return to deflector 125 are substantially the same as in deflector 124 upon injection, so that deflector 125 compensates for the time-of-flight aberrations introduced by deflector 124. The closer the deflectors 124 and 125 are situated to each other, the better the aberration compensation. Alternatively, if only a single deflector is used, the inclination of the ion beam towards the detector 117 is accomplished by means of deflector 124 but with voltage biasing of electrodes 124-1 and 124-1 switched to opposite polarity shortly after all ions of the mass range of interest are injected and have passed for a first time through deflector 124. The injection/detection variants in FIGS. 12A and 12B advantageously allow more space for the RF storage multipole 111 and detector 117, which is not limited by the electrodes comprising mirrors 71, 72.

FIG. 12A and FIG. 12B illustrate how injection and detection may be advantageously arranged out of the X-Y plane occupied by the mass spectrometer. These and other arrangements may be utilised to direct beams into multi-reflection mass spectrometers of the present invention with both +X and −X inclination angles. Ions may be injected into all embodiments of the mass spectrometer of the present invention with both +X and −X inclination angles to proceed through the mass spectrometer at substantially the same time, thereby advantageously doubling the throughput of the spectrometer. This approach may also be utilised with multi-reflection mass spectrometers of the prior art.

Figure 17:
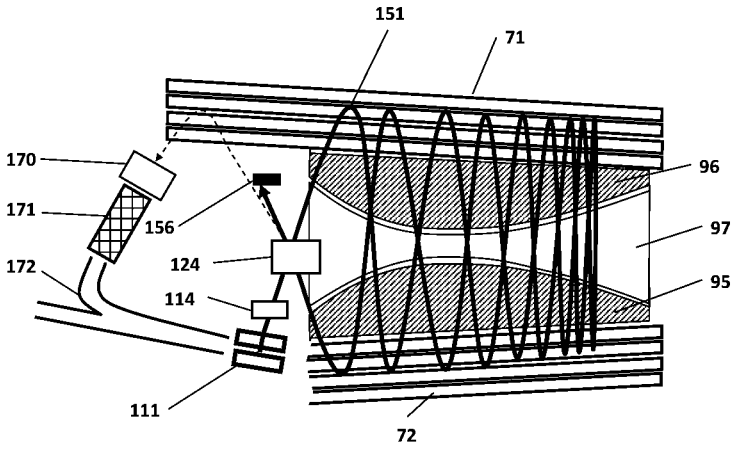
FIG. 17 is a schematic diagram of a multi-reflection mass spectrometer of the present invention further comprising a pulsed ion gate and a fragmentation cell in which ions are selected, fragmented and fragment ions are directed back into the multi-reflection mass spectrometer and subsequently detected. Multiple stages of fragmentation may be performed enabling $MS^n$.

Embodiments of the invention such as those depicted schematically in FIG. 12A and FIG. 12B may be used with a subsequent ion processing means. Instead of proceeding to detector 117, ions may be extracted from or deflected out of the (first) multi-reflection mass spectrometer and proceed into a fragmentation cell, for example, whereupon after fragmentation, ions may be directed to another mass spectrometer, or back into the first multi-reflection mass spectrometer on the same or a different ion path. FIG. 17 is an example of this latter arrangement and will be further described.

Figure 13:
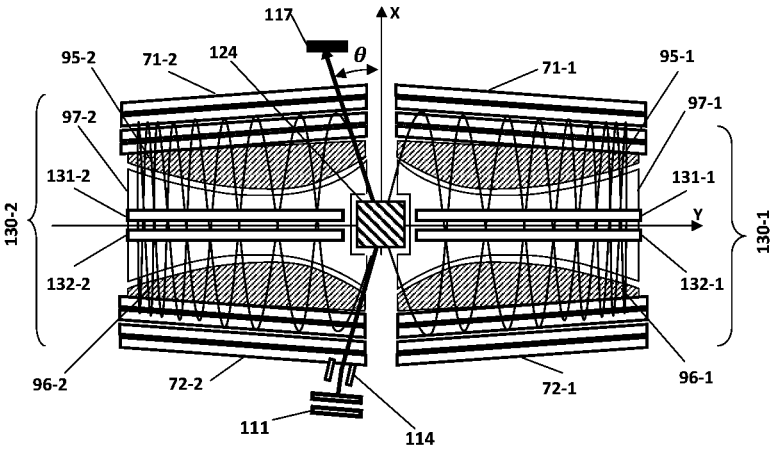
FIG. 13 is a schematic diagram illustrating one embodiment of the present invention in the form of an electrostatic trap.

FIG. 13 is a schematic diagram illustrating one preferred embodiment of the present invention in the form of an electrostatic trap. The electrostatic trap comprises two multi-reflection mass spectrometers comprising two mass spectrometers 130-1 and 130-2, each similar to that already described in relation to FIG. 9, and like components are given like identifiers. In alternative embodiments, mass spectrometers 130-1 and 130-2 may be different though each having substantially equal injection angles θ. Mass spectrometers 130-1 and 130-2 are preferably identical as shown in FIG. 13, and the mass spectrometers are arranged end to end symmetrically about an X axis such that their respective drift directions are collinear, the multi-reflection mass spectrometers thereby defining a volume within which, in use, ions follow a closed path with isochronous properties in both the drift directions and in an ion flight direction. The electrostatic trap comprises four ion-optical mirrors 71, 72 and two sets of compensation electrodes 95, 96, 97. Ion injector, which comprises the storage multipole 111 and compensating deflector 114, injects a pulse of ions into the electrostatic trap preferably as described in relation to FIG. 12A by means of deflector 124. Deflector 124 is located in the mass spectrometers' plane of symmetry. Alternatively, the ion beam is injected in the plane of analyzers 130-1, 130-2 while the electrodes comprising mirrors 72 are biased with zero voltage offsets, and mirrors 72 are switched on after the all ions in the mass range of interest are injected.

A bipolar voltage is initially applied to the pair of electrodes comprising deflector 124, is switched off after the highest-mass ions are deflected into the plane of symmetry and before the lightest-mass ions make a designated number of oscillations between mirrors 71-1 and 72-1 and return to the deflector 124. The ion beam proceeds to the mass spectrometer 130-2 and comes back to mass spectrometer 130-1 after a designated (preferably odd) number of oscillations between mirrors 71-2 and 72-2. The ion trajectories are thus spatially closed, and the ions are allowed to oscillate between the mass spectrometers 130-1, 130-2 repeatedly whilst no bipolar voltage is applied to deflector 124. A unipolar voltage offset could be also applied to electrodes 124 during ion motion in order to focus ion beam and sustain its stability.

Four pairs of stripe-shaped electrodes 131, 132 are used for readout of the induced-current signal on every pass of the ions between the mirrors. The electrodes in each pair are symmetrically separated in the Z-direction and can be located in the planes of compensation electrodes 97 or closer to the ion beam. Electrode pairs 131 are connected to the direct input of a differential amplifier (not shown) and electrode pairs 132 are connected to the inverse input of the differential amplifier, thus providing differential induced-current signal, which advantageously reduces the noise. To obtain the mass spectrum, the induced-current signal is processed in known ways using the Fourier transform algorithms or specialized comb-sampling algorithm, as described by J. B. Greenwood at al. in Rev. Sci. Instr. 82, 043103 (2011).

After a lapse of time, a bipolar voltage may be applied to the electrodes 124 to deflect the ions so that they are diverted from the electrostatic trap and impinge upon a detector 117 which may be a microchannel or microball plate, or a secondary electron multiplier, for example. Either one method of detection or both methods of detection (the induced-current signal from electrodes 131, 132 and the ion signal produced from ions impinging upon detector 117) could advantageously be employed on the same batch of ions.

Figure 14:
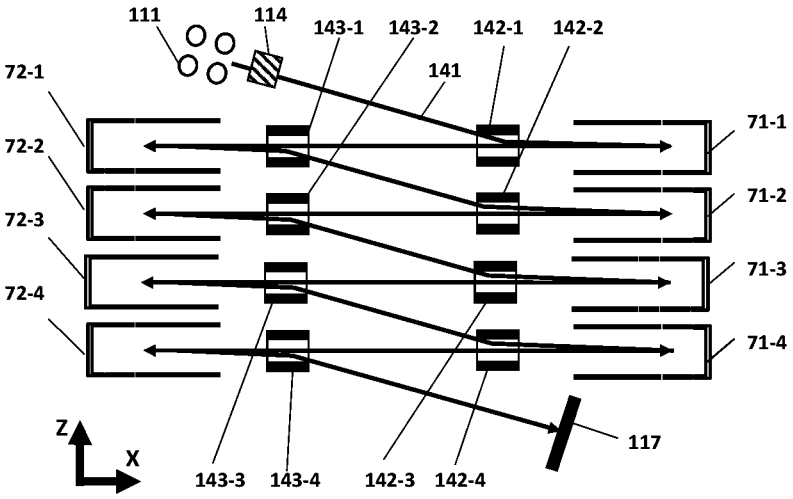
FIG. 14 is a schematic diagram illustrating one embodiment of a composite mass spectrometer comprising four multi-reflection mass spectrometers of the present invention aligned so that the X-Y planes of each mass spectrometer are parallel and displaced from one another in a perpendicular direction Z.

Multi-reflection mass spectrometers of the present invention may be advantageously arranged to form a composite mass spectrometer. FIG. 14 is a schematic diagram illustrating a section through one embodiment of a composite mass spectrometer comprising four multi-reflection mass spectrometers of the present invention aligned so that the X-Y planes of each mass spectrometer are parallel and displaced from one another in a perpendicular direction Z. Each multi-reflection mass spectrometer is of a similar type to that described in relation to FIG. 9, and like components have like identifiers. Pairs of straight mirrors 71, 72 are elongated in a drift direction Y orthogonal to the plane of drawing and converge at an angle Ω (not shown), so that the closest ends of mirrors are the distal ones from the storage multipole 111 and ion detector 117. Mirrors 71-1, 72-1 and 71-3, 72-3 are elongated in positive direction of Y, whilst mirrors 71-2, 72-2 and 71-4, 72-4 are elongated in negative direction of Y. Therefore the ions which emerge from one mass spectrometer at angle θ, can enter the next mass spectrometer with no deflection in the X-Y plane. Each mass spectrometer also contains a set of compensation electrodes which are not shown for clarity.

Ions 141 are injected from the RF storage multipole 111 and the time-of-flight aberrations are corrected with deflector 114 as described in relation to the embodiment of FIG. 11. Ions 141 pass between parallel deflector plates 142-1 which are supplied with a bi-polar voltage so as to deflect the ions into a first multi-reflection mass spectrometer parallel to the X-Y plane and with an appropriate ion injection angle θ in the X-Y plane. The ions are reflected from one mirror 71-1 to a second mirror 72-1 and progress along a drift length in the +Y direction and back as described in relation to embodiment of FIG. 9. Upon making a number of oscillations in the first mass spectrometer, the ions pass between pairs of parallel plate electrodes 143-1 and 142-2 which are both supplied with bi-polar voltages to cause the ions to deflect towards the second spectrometer and enter mirror 71-2 with an appropriate injection angle in the X-Y plane. The ions make a number of oscillations between mirrors 71-2 and 72-2 while drifting in a drift direction towards negative values of Y and back. The ions are in like manner passed from one multi-reflection mass spectrometer to the next, emerging from the last spectrometer to impinge upon detector 117. Advantageously in this embodiment the mirror electrodes and compensating electrodes may be shared between spectrometers. Compensation electrodes may, in alternative embodiments, also be shared between spectrometers. The number of full oscillations between mirrors 71 and 72 in each mass spectrometer is preferably odd, so that coordinate Z and velocity component $\dot{Z}$ of each ion change their signs to opposite between two consequent transitions from one mass spectrometer to another by a pair of deflectors 143 and 142. Therefore the time-of-flight aberrations introduced by one transition are substantially compensated in the course of the next transition.

It will be appreciated that different numbers of multi-reflection mass spectrometers may be stacked one upon the other in this manner. Alternative arrangements may also be conceived in which some or all the multi-reflection mass spectrometers of the invention are located in the same X-Y plane, with ion-optical means to direct the ion beam from one spectrometer to another. All such composite mass spectrometers have the advantage of extended flight path lengths with only modest increases in volume.

Figure 15:
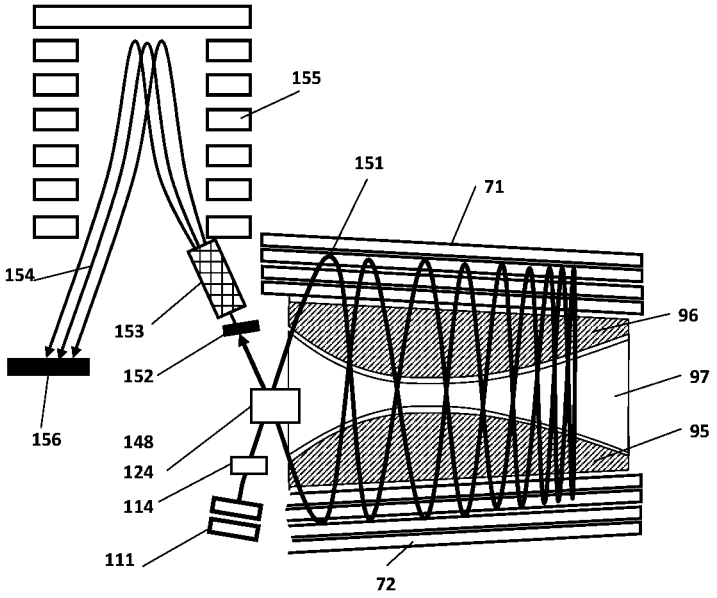
FIG. 15 depicts schematically an analysis system comprising a mass spectrometer of the present invention and, an ion injector comprising an ion trapping device upstream of the mass spectrometer, and a pulsed ion gate, a high energy collision cell and a time-of-flight analyser downstream of the mass spectrometer.

FIG. 15 depicts schematically an analysis system comprising a mass spectrometer of the present invention and, an ion injector comprising RF storage multipole 111, beam deflectors 114, 124 upstream of the mass spectrometer, and, a pulsed ion gate 152, a high energy collision cell 153, a time-of-flight analyser downstream of the mass spectrometer 155, and ion detector 156. In this embodiment, a multi-reflection mass spectrometer as described in relation to FIG. 9 is utilised for tandem mass spectrometry (MS/MS) as is, for example, described by Satoh et. al in J. Am. Soc. Mass Spectrom. 2007, 18, 1318. Like components to those in FIG. 9 have been given like identifiers. The embodiment comprises ion storage multipole 111 shifted from the plane of mass spectrometer in direction orthogonal to the plane of drawing as described in relation to FIG. 12A, and correcting deflectors 114 which operate as described in relation to FIGS. 11A, 11B, with like components having like identifiers. After making a designated number of oscillations between mirrors 71, 72 of the multi-reflection mass spectrometer, the mass-separated ion bunch 151 leaves the mass spectrometer and enters the pulsed ion gate 152 which is open for a short time interval to select a narrow (preferably a single isotope) mass range. The selected ions (precursor ions) are fragmented in collisions with molecules of neutral gas (preferably helium) in the gas-filled high-energy collision dissociation cell 153. The fragment ions 154 are analyzed in secondary time-of-flight analyser which contains isochronous ion mirror 155 (preferably gridless) and ion detector 156. The improved space-charge capacity of the primary mass analyzer makes it possible to select a sufficient number of precursor ions to be fragmented and further analyzed, even in the single-isotope mass selection mode. Downstream mass spectrometer 155 could be also implemented according to this invention, or ions could be redirected back to the same primary mass spectrometer for analysis of fragments as described below.

Figure 16:
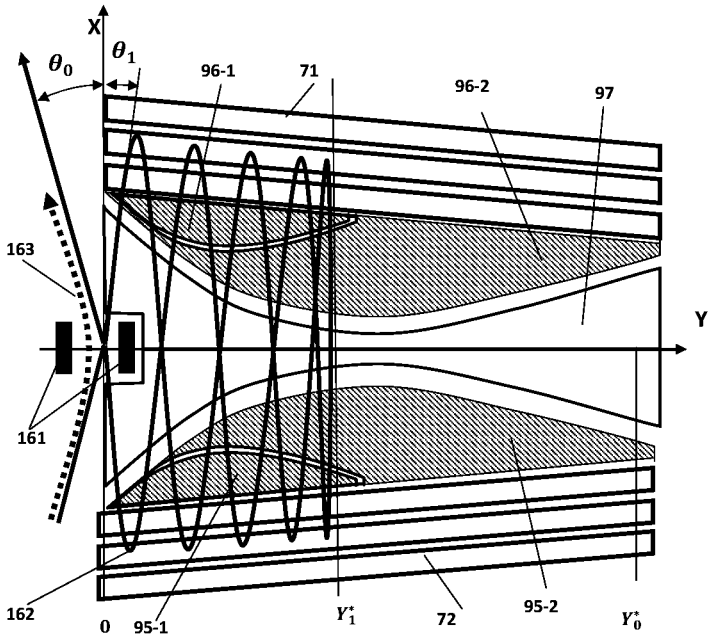
FIG. 16 depicts schematically a multi-reflection mass spectrometer which is a further embodiment of the present invention, comprising five pairs of compensation electrodes and which may be used for mass analyses with increased repetition rate.

The option of adjustable flight length advantageously allows higher repetition rate of mass analysis, though at the expense of mass resolving power. In the mass spectrometer of this invention, however, one cannot change the number of oscillations K by simple adjustment of the compensation electrodes bias voltage and/or the injection angle without violating the previously set conditions for aberration compensation. If some loss in aberration compensation is acceptable however, the oscillation number may be changed over a limited range by said means. Based on dependencies between the principal geometrical parameters $\tan\theta=\pi\pi(1)Y_0^*/2KL(0)$ and $\Omega=m_1\,[L(0)/2Y_0^*]\tan^2\theta$ which are necessary for substantial aberration compensation, the variation of the number of oscillations K under preserved effective mirror separation L(0) and tilt Ω necessarily entails a change of the injection angle θ and the mean drift length $Y_0^*$ in the following proportions: $\tan\theta_1/\tan\theta_0=K_1/K_0$ and $Y_1^*/Y_0^*=(K_1/K_0)^2$. A change of the injection angle in this specified proportion can be realized electrically by means of deflector 161, implemented by various known means and schematically represented by two parallel electrodes in FIG. 16, electrically biased, in use, with a bipolar voltage to deflect ions by equal angles $\Delta\theta=\theta_0-\theta_1$ before and after a designated number of reflections between mirrors 71 and 72. A change of the mean drift length in the specified proportions cannot be implemented, however, by electrical means only in all embodiments described above, because the shape of the compensation electrodes must be necessarily scaled in the drift direction. Compensation electrodes with split geometry, as shown in FIG. 16, can be used for this purpose in all embodiment of the present invention. Ion optical elements in FIG. 16, which are also shown in FIG. 9, have like identifiers. The biased pairs of compensation electrodes 95, 96 are split into two sections each, correspondingly 95-1, 95-2 and 96-1, 96-2, with an isolating gap between them. The shape of electrodes 95-1 and 96-1 is similar to the shape of whole electrodes 95, 96, correspondingly, but scaled in proportion $Y_1^*/Y_0^*$ in the direction Y and, possibly, in the same or different proportion in the orthogonal direction X. In high mass resolution mode, the compensation electrodes 95-1, 95-2 are equally biased and the compensation electrodes 96-1, 96-2 are also equally biased to form an electric potential substantially similar to that generated by non-split biased compensation electrodes. In the low-resolution mode, only electrodes 95-1 and 96-1 are biased whilst electrodes 95-2 and 96-2 are held at the same potential as the unbiased compensation electrode 97. The reduced ion path 162 contains fewer oscillations between mirrors 71 and 72 than is the case in high mass resolution mode. Deflector 161 can also direct the ion beam from an ion source (not shown) to an ion detector (not shown), bypassing the mirrors as shown with dotted line 163, and this mode can be used for self-diagnostics.

All embodiments presented above could be also used for multiple stages of mass analysis in so-called $MS^n$ mode, where a precursor is selected by an ion gating arrangement, fragmented, and a fragment of interest is then optionally selected again and the process is repeated. An example is shown in FIG. 17 where ions are deflected from their path by deflector 124 to the path that leads to the decelerator device 170, RF-only collision cell 171 and return path 172 to the injection device 111. Operation in $MS^n$ mode follows the scheme described in U.S. Pat. No. 7,829,842. Deceleration and reduction of energy spread could be implemented in a pulsed manner as described in U.S. Pat. No. 7,858,929. Multiple injections could be added up into the collision cell as described e.g. in US patent application 2009166528. The return path to the injection device might include then a Y-joint 172 as described in U.S. Pat. No. 7,829,850 or U.S. Pat. No. 7,952,070.

Figure 18:
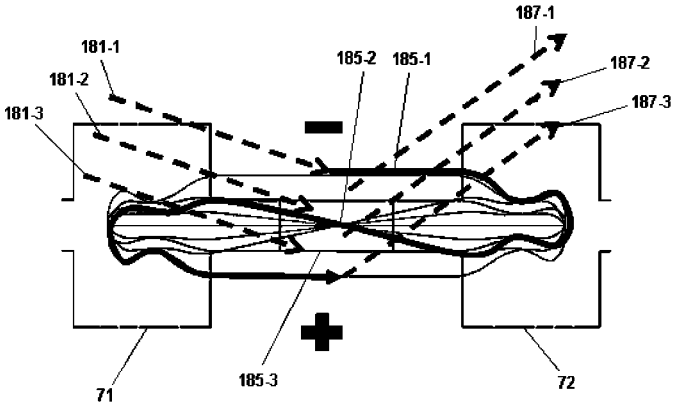
FIG. 18 is a schematic diagram of a multi-reflection mass spectrometer of the present invention illustrating alternative flight paths within the spectrometer.

Use of two different flight paths through the spectrometer, at opposite injection angles, has been described earlier in relation to FIG. 12A and FIG. 12B. In addition to these paths, different ion beam paths displaced from each other in the Z direction may also be used. FIG. 18 is a schematic diagram of a multi-reflection mass spectrometer of the present invention illustrating alternative flight paths within the spectrometer. The spectrometer components of FIG. 18 may be similar to that depicted in FIG. 12A and FIG. 12B and like components have like identifiers. In FIG. 18, injection and detection may, for example, be as depicted in FIG. 12A, and multiple injectors and detectors may be used. Parallel injection paths 181-1, 181-2, 181-3 direct ions into the spectrometer whereupon ions directed along different ion injection paths may be deflected by deflectors (not shown), to follow paths 185-1, 185-2, 185-3. After multiple reflections between opposing ion-optical mirrors 71, 72, ions may be ejected upon different parallel ejection paths 187-1, 187-2, 187-3 to different detectors (not shown).

Figure 19:
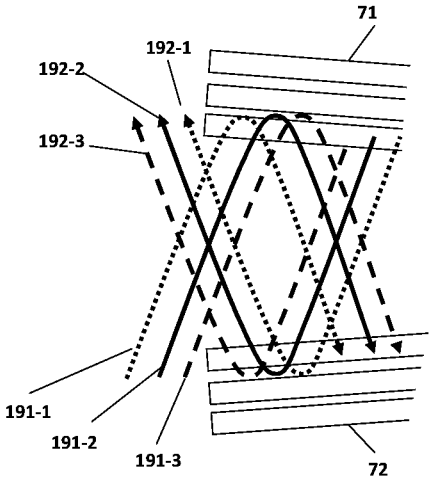
FIG. 19 is a schematic diagram of a further example of a multi-reflection mass spectrometer of the present invention illustrating alternative flight paths within the spectrometer.

FIG. 19 illustrates another embodiment of a multi-channel mass-spectrometer similar to that in FIG. 9 and like components have like identifiers. More than one injected ion beam shown as 191-1, 191-3, and 191-3 enter the mass spectrometer with different offsets along the drift direction being substantially parallel to each other. Upon the same number of oscillations between mirrors 71 and 72, the said ion beams emerge from the spectrometer as shown correspondingly with arrows 192-1, 192-2, and 192-3. The emerged ion beams do not overlap and are substantially parallel to each other and may be directed to different detectors (not shown).

In the embodiments of FIG. 18 and FIG. 19, the different detectors may be similar to one another, or more preferably they may have different dynamic range capabilities. Different ion beams may be directed to different detectors so that intense ion beams reach suitable detectors which can detect them without overload. Staggered detection times facilitate the output of one detector regulating the gain of another. Diaphragms or other means may be used to ensure that only ions that have undergone a desired number of reflections exit the spectrometer and reach a detector. Different sized diaphragms located in the path of different detectors may be used to limit the extent of the ion beam.

Multi-reflection mass spectrometers of the present invention are image-preserving and may be used for simultaneous imaging or for image rastering at a speed independent of the time of flight of ions through the spectrometer.

In all embodiments of the present invention various known ion injectors may be used, such as an orthogonal accelerator, a linear ion trap, a combination of linear ion trap and orthogonal accelerator, an external storage trap such as is described in WO2008/081334 for example.

All embodiments presented above could be also implemented not only as ultra-high resolution TOF instruments but also as low-cost mid-performance analysers. For example, if the ion energy and thus the voltages applied do not exceed few kilovolts, the entire assembly of mirrors and/or compensation electrodes could be implemented as a pair of printed-circuit boards (PCBs) arranged with their printed surfaces parallel to and facing each other, preferably flat and made of FR4 glass-filled epoxy or ceramics, spaced apart by metal spacers and aligned by dowels. PCBs may be glued or otherwise affixed to more resilient material (metal, glass, ceramics, polymer), thus making the system more rigid. Preferably, electrodes on each PCB are defined by laser-cut grooves that provide sufficient isolation against breakdown, whilst at the same time not significantly exposing the dielectric inside. Electrical connections are implemented via the rear surface which does not face the ion beam and may also integrate resistive voltage dividers or entire power supplies. For practical implementations the elongation of the mirrors in the drift direction Y should be minimised in order to reduce the complexity and cost of the design. This could be achieved by known means e.g. by compensating the fringing fields using end electrodes (preferably located at the distance of at least 2-3 times the height of mirror in Z-direction from the closest ion trajectory) or end-PCBs which mimic the potential distribution of infinitely elongated mirrors. In the former case, electrodes could use the same voltages as the mirror electrodes and might be implemented as flat plates of appropriate shape and attached to the mirror electrodes.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to" and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

What is claimed is:

1. A multi-reflection mass spectrometer comprising two ion-optical mirrors, each mirror elongated generally along a drift direction (Y), each mirror opposing the other in an X direction and having a space therebetween, the X direction being orthogonal to the Y direction;

the spectrometer further comprising an ion injector located at one end of the ion-optical mirrors in the drift direction, arranged so that in use it injects ions such that they oscillate between the ion-optical mirrors, reflecting from one mirror to the other generally orthogonally to the drift direction a plurality of times, turning the ions within each mirror whilst the ions proceed along the drift direction Y;

wherein a distance between subsequent points at which the ions turn in the Y-direction changes monotonously with Y during at least a part of the motion of the ions along the drift direction.

2. The multi-reflection mass spectrometer of claim 1 in which the mass spectrometer further comprises one or more compensation electrodes each electrode being located in or adjacent the space extending between the opposing mirrors; wherein the compensation electrodes are, in use, electrically biased such that the distance between subsequent points at which the ions turn in the Y-direction changes monotonously with Y during at least a part of the motion of the ions along the drift direction.

3. The multi-reflection mass spectrometer of claim 2 in which the one or more compensation electrodes comprises a pair of compensation electrodes, each of which is disposed either side of a space between the mirrors and has a surface having a polynomial profile in the X-Y plane such that the surfaces extend towards each mirror a greater distance in regions near one or both the ends of the mirrors than in a central region between the ends.

4. The multi-reflection mass spectrometer of claim 2 in which the one or more compensation electrodes comprises a pair of compensation electrodes, each of which is disposed either side of a space between the mirrors and has a surface having a polynomial profile in an X-Y plane such that the surfaces extend towards each mirror a lesser distance inregions near one or both ends of the mirrors than in a central region between the ends.

5. The multi-reflection mass spectrometer of claim 2 in which the compensation electrodes comprise a plurality of tubes or compartments located at least partially in the space extending between the opposing mirrors.

6. The multi-reflection mass spectrometer of claim 2 in which the one or more compensation electrodes are, in use, electrically biased so as to produce, in at least a portion of the space between the mirrors, an electrical potential offset which varies as a function of the distance along the drift length.

7. The multi-reflection mass spectrometer of claim 1 in which both mirrors are elongated linearly along the drift direction and are arranged an equal distance apart in the X direction.

8. The multi-reflection mass spectrometer of claim 1 in which both mirrors are elongated non-linearly along the drift direction and are arranged to have an equal gap between them.

9. The multi-reflection mass spectrometer of claim 1 in which a period of ion oscillation decreases along at least a portion of the drift length as ions proceed away from the ion injector.

10. The multi-reflection mass spectrometer of claim 1 in which the ions are turned around after passing along the drift length and proceed back along the drift length towards the ion injector.

11. The multi-reflection mass spectrometer of claim 1 further comprising a detector located in a region adjacent the ion injector.

12. The multi-reflection mass spectrometer of claim 1 in further comprising one or more lenses or diaphragms located in a space between the mirrors so as to affect a phase-space volume of ions within the mass spectrometer.

13. The multi-reflection mass spectrometer of claim 1 in which, in use, the ion injector injects ions from one end of the mirrors into a space between the mirrors at an inclination angle in an X-Y plane such that ions are reflected from one opposing mirror to the other a plurality of times whilst drifting along a drift direction away from the ion injector so as to follow a generally zigzag path within the mass spectrometer.

14. The multi-reflection mass spectrometer of claim 13 in which a motion of ions along the drift direction is opposed by electric field components resulting from one or more electrically biased compensation electrodes.

15. The multi-reflection mass spectrometer of claim 14 in which the said electric field components cause the ions to reverse their direction and travel back towards the ion injector.

16. The multi-reflection mass spectrometer of claim 15 in which at least some of the ions impinge upon a detector located in a region adjacent the ion injector.

17. The multi-reflection mass spectrometer of claim 16 wherein the detector has a detection surface which is arranged parallel to the drift direction Y.

18. The multi-reflection mass spectrometer of claim 1 wherein both mirrors are implemented as a pair of printed-circuit boards arranged with their printed surfaces parallel to and facing each other.

19. The multi-reflection mass spectrometer of claim 2 wherein both compensation electrodes are implemented as a pair of printed-circuit boards arranged with their printed surfaces parallel to and facing each other.

20. The multi-reflection mass spectrometer of claim 1, wherein the multi-reflection mass spectrometer is a time-of-flight multi-reflection mass spectrometer.

21. An electrostatic trap mass spectrometer comprising two or more multi-reflection mass spectrometers, wherein each multi-reflection mass spectrometer comprises two ion-optical mirrors, each mirror elongated generally along a drift direction (Y), each mirror opposing the other in an X direction and having a space therebetween, the X direction being orthogonal to Y;

the mass spectrometer further comprising an ion injector located at one end of the ion-optical mirrors in the drift direction, arranged so that in use it injects ions such that they oscillate between the ion-optical mirrors, reflecting from one mirror to the other generally orthogonally to the drift direction a plurality of times, turning the ions within each mirror whilst the ions proceed along the drift direction Y; wherein the distance between subsequent points at which the ions turn in the Y-direction changes monotonously with Y during at least a part of the motion of the ions along the drift direction.

22. The electrostatic trap mass spectrometer of claim 21 comprising two multi-reflection mass spectrometers arranged end to end symmetrically about an X axis such that their respective drift directions are collinear, the multi-reflection mass spectrometers thereby defining a volume within which, in use, ions follow a closed path with isochronous properties in both the drift directions and in an ion flight direction.

23. A composite mass spectrometer comprising two or more multi-reflection mass spectrometers wherein each multi-reflection mass spectrometer comprises two ion-optical mirrors, each mirror elongated generally along a drift direction (Y), each mirror opposing the other in an X direction and having a space therebetween, the X direction being orthogonal to Y;

the mass spectrometer further comprising an ion injector located at one end of the ion-optical mirrors in the drift direction, arranged so that in use it injects ions such that they oscillate between the ion-optical mirrors, reflecting from one mirror to the other generally orthogonally to the drift direction a plurality of times, turning the ions within each mirror whilst the ions proceed along the drift direction Y; wherein the distance between subsequent points at which the ions turn in the Y-direction changes monotonously with Y during at least a part of the motion of the ions along the drift direction, the two or more multi-reflection mass spectrometers being aligned so that the X-Y planes of each mass spectrometer are parallel and optionally displaced from one another in a perpendicular direction Z, the composite mass spectrometer further comprising ion-optical means to direct ions from one multi-reflection mass spectrometer to another.

24. A method of mass spectrometry comprising the steps of injecting ions into a multi-reflection mass spectrometer comprising two ion-optical mirrors, each mirror elongated generally along a drift direction (Y), each mirror opposing the other in an X direction, the X direction being orthogonal to Y, reflecting the ions from one mirror to the other generally orthogonally to the drift direction a plurality of times by turning the ions within each mirror whilst the ions proceed along the drift direction Y, wherein the distance between subsequent points in the Y-direction at which the ions turn monotonously changes with Y during at least a part of the motion of the ions along the drift direction; and detecting at least some of the ions during or after their passage through the mass spectrometer.

25. The method of mass spectrometry of claim 24, wherein the multi-reflection mass spectrometer further comprises one or more electrically biased compensation electrodes, each electrode being located in or adjacent the space extending between the opposing mirrors; the method comprising electrically biasing the compensation electrodes such that the distance between subsequent points at which the ions turn in the Y-direction changes monotonously with Y during at least a part of the motion of the ions along the drift direction.

26. The method of mass spectrometry of claim 24, wherein more than one detector is used to detect at least some of the ions during or after their passage through the mass spectrometer.

27. The method of mass spectrometry of claim 24, wherein subsequent stages of mass analysis ($MS^n$) are carried out using the said mass spectrometer.

28. The method of mass spectrometry of claim 24 in which the ions are turned around after passing along the drift length and proceed back along the drift length towards the region at which ions were injected.

29. The method of mass spectrometry of claim 24 in which both mirrors are elongated linearly along the drift direction and are arranged an equal distance apart in the X direction.

30. The method of mass spectrometry of claim 24 in which both mirrors are elongated non-linearly along the drift direction and are arranged to have an equal gap between them.

31. The method of mass spectrometry of claim 24 in which the one or more compensation electrodes comprises a pair of compensation electrodes each electrode being located either side of the space between the mirrors, and in which each of the compensation electrodes has a surface having a polynomial profile in the X-Y plane such that the said surfaces extend towards each mirror a greater distance in the regions near one or both the ends of the mirrors than in the central region between the ends.

32. The method of mass spectrometry of claim 24 in which the one or more compensation electrodes comprises a pair of compensation electrodes each electrode being located either side of the space between the mirrors, and in which each of the compensation electrodes has a surface having a polynomial profile in the X-Y plane such that the said surfaces extend towards each mirror a lesser distance in the regions near one or both the ends of the mirrors than in the central region between the ends.

33. The method of mass spectrometry of claim 24 in which the one or more compensation electrodes comprise a plurality of tubes or compartments located at least partially in the space extending between the opposing mirrors.

34. The method of mass spectrometry of claim 24 in which the mass spectrometer further comprises one or more lenses or diaphragms located in the space between the mirrors so as to affect the phase-space volume of ions within the mass spectrometer.

35. The method of mass spectrometry of claim 24 in which at least some of the ions impinge upon a detector located in a region adjacent the region at which ions were injected.

36. The method of mass spectrometry of claim 35 wherein the detector has a detection surface which is arranged parallel to the drift direction Y.

* * * * *